US005579334A

United States Patent [19]

Baxter et al.

[11] Patent Number: 5,579,334

[45] Date of Patent: Nov. 26, 1996

[54] METHOD AND APPARATUS FOR REACTING SOLID PARTICULATE REAGENTS IN AN ELECTRIC FURNACE

[76] Inventors: Rodney C. Baxter, 32 Woodland Park, Spitfire Road, Sunninghill; Derek R. Oldnall, 54 King Street, Irene; Bodo R. Rohrmann, 21 Den Haag Street, Die Heuwel, Witbank, all of South Africa

[21] Appl. No.: 397,350

[22] Filed: Mar. 2, 1995

[51] Int. Cl.[6] ..... H05B 3/00

[52] U.S. Cl. ..... 373/109; 373/3; 373/111; 432/128

[58] Field of Search ..... 373/109, 111, 373/115, 116, 117, 118, 122, 2, 3, 62, 63; 432/128

[56] References Cited

U.S. PATENT DOCUMENTS

| | | | |
|---|---|---|---|
| 1,408,661 | 3/1922 | Bichowsky et al. . | |
| 2,926,071 | 2/1960 | Alexander | 23/191 |
| 3,036,888 | 5/1962 | Lowe | 23/191 |
| 3,042,492 | 7/1962 | Thomsen | 23/202 |
| 3,752,897 | 8/1973 | Atsukawa | 373/115 |
| 4,127,737 | 11/1978 | Hirakawa | 13/7 |
| 4,155,704 | 5/1979 | Kulabukhov et al. | 432/105 |
| 4,624,003 | 11/1986 | Eirich et al. | 373/120 |
| 5,096,674 | 3/1992 | Shingai | 422/204 |
| 5,219,535 | 6/1993 | Giacobbe et al. | 422/201 |
| 5,317,592 | 5/1994 | Van Staden | 373/109 |

FOREIGN PATENT DOCUMENTS

| | | |
|---|---|---|
| 4304217 | 8/1994 | Denmark . |
| 1265686 | 5/1961 | France . |
| 2226063 | 11/1974 | France . |
| 2343213 | 3/1977 | France . |
| 2339135 | 8/1977 | France . |
| 2355259 | 1/1978 | France . |
| 1370652 | 10/1974 | United Kingdom . |
| 1417050 | 12/1975 | United Kingdom . |
| 2051325 | 1/1981 | United Kingdom . |

*Primary Examiner*—Tu Hoang
*Attorney, Agent, or Firm*—Arnold, White & Durkee

[57] ABSTRACT

A furnace comprises a furnace shell rotatable about a rotational axis. The furnace shell provides a furnace chamber for holding a solid particulate reagent as the furnace shell rotates. At least two electrodes are exposed to the chamber and are mounted in electrically insulated fashion therein. The electrodes are spaced apart so that solid particulate reagent in the furnace chamber can be heated up by direct resistance heating thereof, utilizing the electrodes.

25 Claims, 15 Drawing Sheets

METHOD AND APPARATUS FOR REACTING SOLID PARTICULATE REAGENTS IN AN ELECTRIC FURNACE

BACKGROUND OF THE INVENTION

1. Field of the Invention

This invention relates to a furnace. It relates also to a method of carrying out a reaction, utilizing the furnace.

2. Summary of the Invention

According to a first aspect of the invention, there is provided a furnace comprising a furnace shell rotatable about a rotational axis, the furnace shell providing a furnace chamber for holding a solid particulate reagent as the furnace shell rotates; and at least two electrodes exposed to the chamber and being mounted in electrically insulated fashion therein, with the electrodes being spaced apart so that solid particulate reagent in the furnace chamber can be heated up by direct resistance heating thereof, utilizing the electrodes.

The furnace shell will normally be cylindrical, and be located substantially horizontally so that the rotational axis extends substantially horizontally.

The furnace is suitable for carrying out reactions whereby a solid particulate reagent is reacted with a further reagent at elevated temperature. The reactions may be endothermic or exothermic. Examples of endothermic reactions are nitriding of a titanium-containing material as the solid particulate reagent, such as a titaniferous ore or slag, to convert titanium values therein to titanium nitride; nitriding of a vanadium containing material; and the carbiding of silicon-bearing material. The solid reagent is thus heated to said elevated temperature, and is supplied with heat for the endothermic reaction at said elevated temperature, by direct resistance heating thereof in the furnace chamber. The furnace can also be used for the regeneration of spent activated carbon.

In other words, an electrical potential or voltage is applied to the material of the solid reagent whereby an electrical current is passed by means of the electrodes, through the material, thereby generating heat within the material, to raise the temperature of the material to the elevated temperature, to supply heat at that temperature for the endothermic reaction (where applicable) and/or to enhance the reactivity of the reactants. Thus, the electrodes will be of different polarity.

Thus, according to a second aspect of the invention, there is provided a method of carrying out a reaction which includes heating the solid reagent to the elevated temperature in the furnace chamber of a furnace as hereinbefore described.

The method may include introducing a second or further reagent into the chamber, to react with the solid reagent. The further reagent may be a further solid reagent, but is typically a gaseous reagent. The gaseous reagent can then be passed over the solid reagent in the furnace chamber and/or through it, e.g. by being introduced into the bottom of a bed of the material in the chamber.

By 'particulate' is meant any desired particle shape and size. Thus, the solid reagent particles can have an irregular shape and fall within a predetermined range of sizes, as would be the case when it comprises ore which has been mined and milled. Instead, it can be of regular shape and size, e.g. in the form of a powder, granules, pellets, briquettes, or the like.

The elevated temperature at which the reaction takes place may be 1000°–1800° C., preferably 1100°–1600° C.

and more preferably 1200°–1350° C., and the voltage applied to the material will be selected accordingly, bearing in mind the resistivity of the material.

Certain solid reagent materials to which it is contemplated the method will in practice be applied, such as titaniferous ores (e.g. ilmenites) or titaniferous slags, which are to be reacted with gaseous nitrogen to nitride titanium values therein, can be relatively non-conductive to electricity at ambient temperatures. For such materials, initial heating may be by other methods, such as preheating the solid reagent by radiative, convectional and/or thermal-conductive methods, to raise the temperature of the material from ambient temperature up to an intermediate value at which ohmic- or direct-resistance heating is effective, after which the ohmic- or direct-resistance heating can be employed further to raise the temperature of the material up to its final value, and to supply the heat needed for the endothermic reaction. Such intermediate value may be 700°–1300° C., preferably 700°–1000° C., e.g. 700°–800° C.

Instead or in addition, the method may include the step of mixing the solid reagent in particulate form with a particulate solid electrical conductor, to provide a mixture having increased electrical conductivity compared with that of the solid reagent. The mixture may be compacted or consolidated, e.g. by pelletising, extruding or briquetting the mixture, further to increase said conductivity. For the mixing, the solid reagent and electrical conductor may be in finely divided form, having a particle size of at most 1000 μm, e.g. 50–200 μm, and the consolidation, at least in the case of briquetting, may be by subjecting the mixture to a pressure of at least 8–11 MPa. Carbon may be employed as the electrical conductor, and has the advantage, in the nitriding of titanium-containing solid reagents, of providing a reducing environment for the endothermic nitriding reaction. The pellets or briquettes may be in the size range 5–80 mm, e.g. 10–20 mm.

When carbon is used as the electrical conductor, it may form 10–90% by mass of the mixture, e.g. 12–60% thereof. The carbon may be in the form of coal, anthracite, coke, industrial char, charcoal, graphite or the like, in particular duff coal, which is readily obtainable and inexpensive.

The ohmic- or direct-resistance heating is thus applied to a moving bed of the solid reagent, e.g. a moving bed of said pellets or briquettes, in the furnace chamber as it rotates so that any preferential paths through the bed of material along which electrical currents pass in response to the applied voltage are continuously or intermittently disrupted, and so that more or less uniform heating of the particulate material is promoted.

The spacing between the electrodes may be 100–1000 mm, typically selected on the basis of the loading or proposed loading of solid material in the furnace chamber, ie the furnace chamber capacity, the resistivity of the solid material, and the required operating voltage. Such spacings permit operating voltages conveniently of 100–200 V to be used, although higher spacings of up to 1,5–3 m or more, requiring voltages of 350–500 V or more, can in principle be feasible.

The power supply used may be AC or DC.

In accordance with the method, the operating voltage between the electrodes may be altered from time to time, either manually or automatically by means of an automated control system, which may be electronic, in response to changes in the temperature of the solid reactant in the interior of the furnace, ie in the furnace chamber, which temperature may be sensed e.g. by suitably located thermocouples in the interior of the furnace. In this way, the operating voltage can be increased to increase the power supply to the furnace and hence to increase the temperature of the solid reagent, or said voltage can be reduced to reduce the power supply and temperature. In one embodiment three voltages may be employed, e.g. 60 V, 110 V and 220 V, the lowermost voltage being used when the solid reagent temperature exceeds a desired value by more than a predetermined amount, the uppermost voltage being used when said reagent temperature falls short of the desired value by more than a predetermined amount, and the intermediate voltage being used when the reagent temperature is closer to the desired value than said predetermined amounts. Instead, e.g. 380 V can be used for start-up, whereafter two voltages such as 110 V and 200 V may be used, the lower voltage being used when the reagent temperature is above the desired temperature and the higher voltage being used when the reagent temperature is below the desired temperature.

When the particulate solid electrical conductor which is mixed with the solid reagent is carbonaceous, e.g. duff coal, the heating of the solid reagent to operating temperature can give rise to the production of a combustible off-gas in the interior of the furnace, containing carbon monoxide, vaporized volatile coal constituents or the like. The method may include the step of burning this off gas to provide the heat used for preheating the solid reagent, as described above, although electrical or any other suitable heating may naturally be used instead.

When the furnace is operated with a nitrogen atmosphere, as mentioned above, and a carbonaceous particulate solid electrical conductor is used, mixed with a solid reagent containing titanium values, suitable control of the reaction environment in the furnace can permit not only the nitriding of the titanium values, but, instead or in addition, the carhiding, carbonitriding or oxycarbonitriding thereof, which permits the production, as desired, of titanium nitride, titanium carbide and/or titanium carbonitride. It will further be appreciated that, although the description of the present invention emphasizes the nitriding of titanium, it may easily, in analogous fashion, be applied to reactions involving other solid reagents, e.g. for the nitriding, carbiding or carbonitriding thereof, such as in the production silicon carbide by reacting a solid reagent comprising silicon with a solid carbon-containing reductant in an inert environment in the furnace. Bearing in mind that the carbonaceous particulate material such as duff coal can have the functions, for a titanium-containing solid reagent, of both increasing electrical conductivity of the solid reagent and of providing off-gas for preheating, an excess thereof is preferably used over the stoichiometric requirement for reducing all the titanium (as the oxide) in the solid reagent, conveniently double said stoichiometric requirement of carbonaceous material is used.

Surprisingly, the Applicant has found that, in the case where the solid reagent is vanadium-bearing material, titanium-bearing material, or silicon-bearing material, the increased conductivity of the solid reagent (whether or not it is with any particulate conductor to raise its conductivity) achieved by preheating the solid reagent, is related to the rate of heating the solid reagent, and is related to the rate at which any carbonaceous material mixed with the solid reagent is devolatalized. It is accordingly desirable to preheat as quickly as possible, e.g. at least 20° C./min, preferably at least 80° C./min.

The method may be carried out batchwise, whereby a charge of solid reagent is charged into the furnace chamber and heated to cause the required reaction to take place, before being discharged and replaced by a succeeding charge; or it may be continuous, a stream of solid reagent passing continuously through the furnace, where it is subjected to required reaction.

The furnace may thus be constructed to cause or permit passage therethrough of both the solid reagent and the gaseous reagent, to permit the continuous operation, and may have an interior which is sealed off from the atmosphere. The furnace shell may comprise an outer skin or wall, lined with a suitably inert shock-resistant electronically non-conductive and thermally insulating refractory lining, e.g. a calcium silicate and/or an α-alumina lining; and the spacing of the electrodes, which may be of copper, silicon carbide or preferably of graphite, may be as described above. The electrode material will be selected according to the operating temperatures and conditions. Thus, at lower operating temperatures, copper electrodes can be used, while at higher temperatures, graphite electrodes can be used. While the furnace may in principle have any suitable construction, such as a vibratory table located in its furnace chamber, to convey the solid reagent through its interior, e.g. from an inlet to its furnace chamber to an outlet therefrom for continuous operation, the furnace is conveniently such that rotation of the furnace shell causes passage of solid reagent through or along its chamber. The furnace will naturally include suitable drive means for driving the shell to rotate.

The furnace or kiln may be provided with an alternating current (AC) or direct current (DC) power supply to the electrodes, via one or more suitable slip-rings mounted on the furnace. Similarly, the furnace may have a slip-ring arrangement connected e.g. to one or more thermocouples arranged in the furnace chamber, for monitoring the temperature in the chamber. The electrodes may thus be arranged in one or more pairs in the interior of the furnace so that they are located at suitable locations and spacings whereby the passage of an electrical current between the electrodes of each pair in response to application thereto of a sufficient electrical potential is promoted, and the passage of electrical current between electrodes of different pairs is discouraged.

The potential difference between the electrodes of a pair, measured through the solid reagent, is proportional to the distance between the electrodes, so that the distance between the electrodes of a pair is in principle limited only by the voltage supply available; however, the voltage is also a function of the nature and resistivity of the solid reagent. Excessive voltages can cause difficulties related to unwanted electrical discharges between the electrodes across the surface of the solid reagent, along the surface of the insulating refractory lining of the furnace or through the refractory lining to the exterior of the furnace.

According to one embodiment of the invention, each of the electrodes may be of annular form and extend circumferentially along an inner surface of the furnace shell while protruding radially inwardly therefrom, with the electrodes being spaced axially or longitudinally apart.

However, the invention also contemplates the provision of a plurality of pairs of the electrodes in the furnace, the electrodes of each pair being spaced from one another and the pairs of electrodes being arranged and located in the interior of the furnace so than electrical discharges will take place only between the electrodes of said pairs, and not between electrodes of different pairs; and so that a relatively long rotary furnace can be used with relatively small spacings between the electrodes of each pair, thereby permitting relatively low voltages (e.g. 100–250 V) to be used. Thus, for example, the pairs of electrodes may be spaced longitudinally from one another.

According to another embodiment of the invention, one of the electrodes ('the first electrode') may extend centrally along the rotational axis, with a plurality of the other electrodes ('the second electrodes') being provided, the second electrodes protruding from and extending along an inner surface of the furnace shell in a longitudinal direction, and being spaced circumferentially from one another. The central electrode will thus be of a particular polarity, with the second electrodes being of opposite polarity, to provide for current flows between the central electrode and those second peripheral electrodes which are at any time submerged by the particulate material in the furnace, the furnace being operated with a bed of particulate material therein of sufficient depth to be in contact with the central electrode.

In yet a further embodiment, a plurality of the electrodes, arranged in pairs, e.g. three pairs, and protruding from and extending along an inner surface of the furnace shell in the longitudinal direction, may be provided, with the pairs being circumferentially spaced from one another, and the electrodes of each pair being spaced circumferentially from each other by a spacing which is less than the spacing between adjacent pairs. In this case, as with the electrodes discussed above, the electrodes may stand proud of the surface of the lining. They can then also act as lifters for lifting particulate material in the kiln as it rotates, thereby assisting in keeping the particulate material continuously in motion and mixing it, to disrupt the paths of electrical currents flowing therethrough. In a still further embodiment, the electrodes may be of non-annular form, and protrude from an inner surface of the furnace shell, with the one electrode ('the first electrode') being spaced longitudinally from the other electrode ('the second electrode'). A plurality of the first electrodes, circumferentially aligned and spaced apart circumferentially, and being of the same polarity, as well as a plurality of the second electrodes, circumferentially aligned and spaced apart circumferentially, and being of the same polarity, may be provided. Thus, the first electrodes will be in the form of a group, while the second electrodes will also be in the form of a group, with the groups being spaced axially or longitudinally and the electrodes of one group being of different polarity to those in the other groups. The electrodes of the first group may be aligned with those in the second group, in the longitudinal direction. If desired, a further group of the first electrodes, spaced axially or longitudinally from the group of second electrodes so that the group of second electrodes is located between the two groups of first electrodes, may be provided.

The Applicant has found, that in certain cases, the resistivity of the solid reagent decreases as the temperature of the solid reagent increases with heating thereof and/or as the solid reagent reacts progressively with the gaseous reagent (thereby progressively changing the composition of the solid reagent) so that, after such heating and/or reaction, a relatively lower voltage is required to maintain a consistent current flow in the solid reagent.

Thus the method may include the step of passing the solid reagent through a series of successive furnace chambers or reaction zones, each chamber or zone including said at least two electrodes. The spacing between the electrodes in each succeeding zone may then be greater than that of the preceding zone. The method may in this case, in particular, include passing the solid reagent through the zones so that it forms a separate bed in each zone, with the beds being electrically isolated from each other.

Thus, the material dams up in each segment, so that at least some parameters can be controlled separately in each segment, e.g. temperature, residence time, and applied voltage.

In this way, by selecting zones of appropriate size or length-for a particular solid reagent and a particular gaseous reagent, substantially the same voltage may be used for each pair of electrodes in each of the zones, despite variations of the spacing between the electrodes in the different zones. In particular, in the case of three zones, a single three-phase source of power can be used with one said phase supplying power to each of said zones.

Thus, the furnace may include a second substantially horizontal cylindrical furnace shell rotatable about the rotational axis and spaced axially or longitudinally from the other or first furnace shell, the second furnace shell providing a second furnace chamber or reaction zone which is in communication with the first furnace chamber or reaction zone and through which solid particulate reactant from the first chamber can pass in the longitudinal direction, and with said at least two electrodes also being provided in the second furnace chamber. If desired, at least one further similar horizontal cylindrical furnace shell may be provided adjacent the second furnace shell, to provide the successive reaction zones.

The first and second chambers may have the same or different diameters. For example, the second chamber may have a greater diameter than the first chamber.

Additionally or instead, the first and second furnace shells may be of the same or different length, and the spacing between the electrodes of the first furnace shell may be the same of different to that of the electrodes of the second furnace shell.

In other words, the furnace can thus be segmented, comprising a series of axially spaced portions or segments, each containing a pair of the electrodes. Each segment may be of a different diameter from the adjacent portion or segment. Thus, the furnace may comprise a plurality of such segments increasing progressively in diameter from one portion to the next, the portion of smallest diameter being at the upstream end of the furnace relative to the direction of solid reagent flow.

Instead, the furnace may comprise a plurality of successive segments of the same or generally similar diameter, each successive segment being longer, in a downstream direction, than the segment preceding it, and the distance between the electrodes of each successive segment being correspondingly greater. This construction takes advantage of the finding by the Applicant, referred to above, that the resistivity of the solid reagent, and hence the voltage required to cause passage of a current of a given value through a given mass or volume of the solid reagent, decreases as the temperature of the solid reagent is increased and/or as the solid reagent progressively undergoes reaction with the gaseous reagent.

For example, the furnace may comprise three successive segments, each having first and second electrodes, in which the distance between the electrodes in successive segments is 650–750 mm, 850–950 mm and 1050–1250 mm respectively, the inner diameter of the furnace chamber being 500 mm.

The inner surface of the lining of the furnace is preferably smooth and both non-porous and electrically insulating, so that impregnation thereof or coating thereof by solid reagent and particularly by any particulate solid conductor added to said reagent is discouraged. As mentioned above, α-alumina such as castable α-alumina, has been found to be suitable for this purpose.

Preferably the furnace has its interior closed off from the atmosphere and/or is operable at above atmospheric pressure to permit maintenance of a controlled atmosphere therein.

The furnace axis may be tilted at an angle of about 1°–3°, preferably about 2° to the horizontal, the downstream end being the lower end, to assist in passage of solid material through the chamber.

The furnace may be provided with longitudinally spaced annular isolating partitions for electrically isolating solid reagent in one segment from that in an adjacent segment. The partitions will be of a refractory and preferably insulating material. The furnace may, further, be provided with lifting members or bars which, as the furnace rotates, cause solid material to be lifted and transferred progressively from one segment to an adjacent segment.

The furnace may include feed and extraction means for feeding and extracting solid reagent and waste product therefrom, as well as gas feed means and gas extraction means for feeding gas into and withdrawing it from the chamber respectively.

The gas feed means may include a plurality of gas permeable distributors in the furnace shell, the distributors being circumferentially spaced from one another; gas delivery means for delivering gas to the outsides of the distributors, with the gas passing through the distributors into the furnace chamber; and gas flow control means operable, during rotation of the furnace, to deliver gas only to those distributors which are at or near their lowermost position so that, in use, inflowing gas passes largely through a charge of solid particulate reagent in the furnace chamber.

BRIEF DESCRIPTION OF THE DRAWING

The invention will now be described, by way of example, with reference to the following Examples and with reference to the accompanying diagrammatic drawings, in which.

DESCRIPTION OF THE PREFERRED EMBODIMENTS

Figure 1:
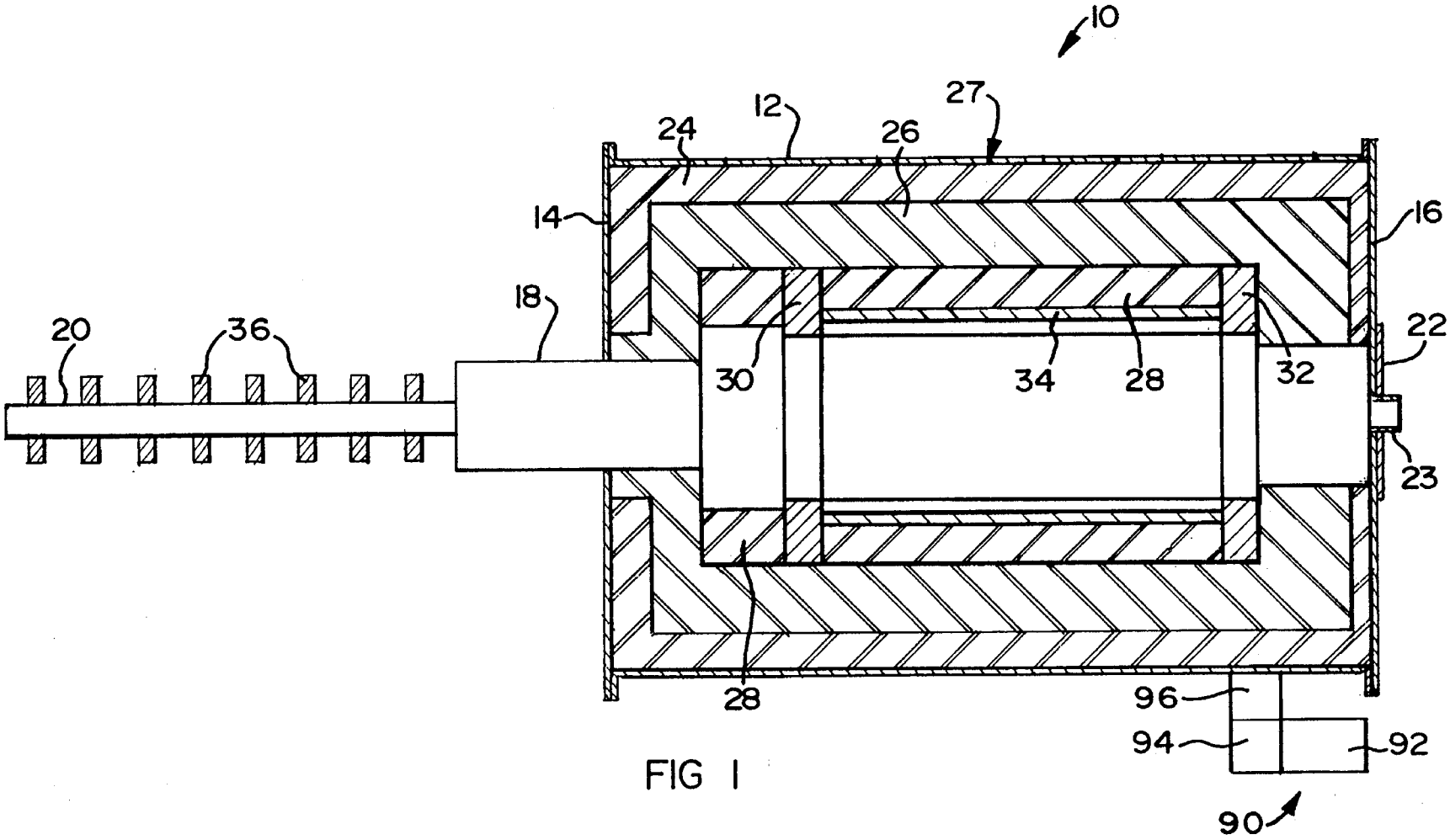
FIG. 1 shows a schematic sectional side elevation of a furnace in accordance with a first embodiment of the present invention.

In the drawings, the same or similar parks are indicated with the same reference numerals.

Referring to FIG. 1 a rotary batch-operation furnace in accordance with a first embodiment of the present invention, and suitable for pilot scale batch operation, is designated by reference numeral 10. The furnace has a hollow-cylindrical outer mild steel wall 12, closed off by annular mild steel end plates 14 and 16 at opposite ends thereof. The central opening of the end plate 14 forms an inlet to the furnace chamber or interior and opens into a gas inlet passage 18 with an extension 20. The end plate 16 has an annular hinged door 22 provided with a spigot 23 through which the furnace is loaded, discharged and sampled and which, thus, forms a sampling port into the interior of the furnace and a gas outlet therefor.

The wall 12 and end plates 14, 16 are lined on their inner surfaces by a lining 24 of electrically insulating calcium silicate bricks, which lining 24 is, in turn, internally lined by a lining 26 of electrically insulating refractory bricks, a layer of ceramic fibre paper at 27 being provided between the linings 12 and 24. The lining 26 has a cylindrical part on which is provided a cylindrical internal lining 28, also of electrically insulating refractory bricks, at opposite ends of which are mounted, on the lining 26, a pair of annular axially or longitudinally spaced circumferentially extending graphite electrodes 30 and 32, ie a first electrode 30 and a second electrode 32. The inner peripheries of the electrodes 30, 32 stand radially inwardly proud of the inner surface of the lining 28. Two castable a-alumina retorts, each 500 mm in length and shown, schematically at 34, define a further non-porous inner lining which abuts the lining 28. The retorts 34 are recessed by about 10–15 mm from the inner peripheries of the electrodes 30, 32. The join between the retorts 34 is sealed with refractory concrete (not shown). The electrodes 30, 32 are spaced apart by 1000 mm and are connected to a single-phase AC power supply.

The extension 20 is provided, on its outer surface, with a plurality of slip rings 36, some of which are connected to various thermocouples (not shown) in the furnace by electrical leads (not shown), and two of which are connected respectively no the electrodes 30, 32 by electrical leads (also not shown).

Operation of the furnace of FIG. 1 will now be described by way of illustrative non-limiting example, with reference to the following Examples.

EXAMPLE 1

A 20 kg batch of solid material was prepared by mixing together a solid particulate ilmenite reagent with a particulate solid electrical conductor in the form of duff coal, there being 858 g of duff coal/kg reagent, amounting to about double the amount of duff coal required to provide sufficient carbon to reduce all the titanium and iron (as the oxides) in the limetire. The ilmenite had the composition given in the Table hereunder. By 'particulate ilmenite' is meant ilmenite as mined and milled, and having irregular shaped particles of different sizes.

Figure 3:
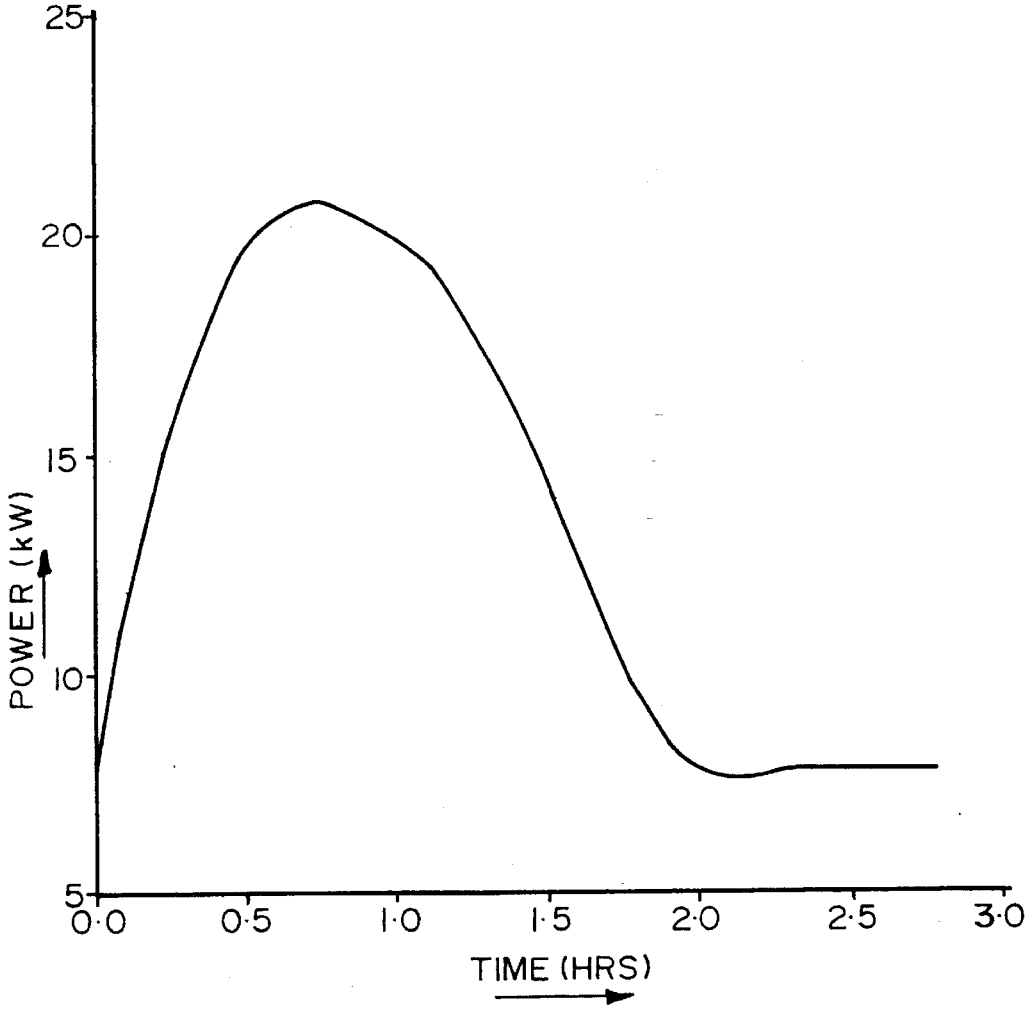
FIG. 3 shows a plot of power input against time for activated carbon used in a batch-type method according to the present invention carried out in the furnace of FIG. 1.
Figure 4:
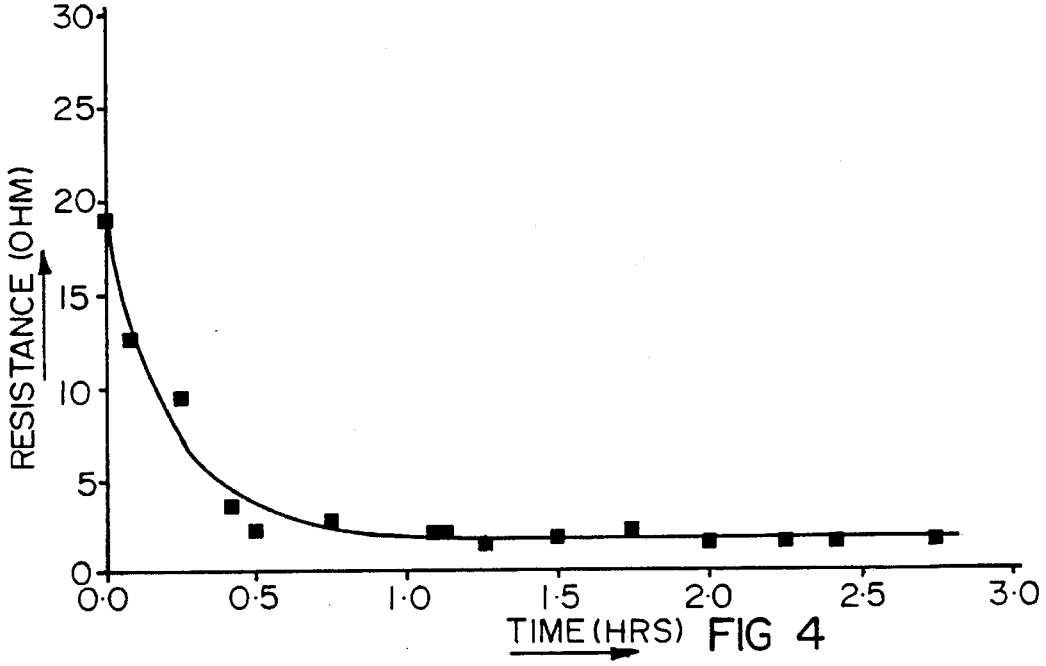
FIG. 4 shows a plot of resistance against time for the activated carbon whose power input is plotted in FIG. 3.
Figure 5:
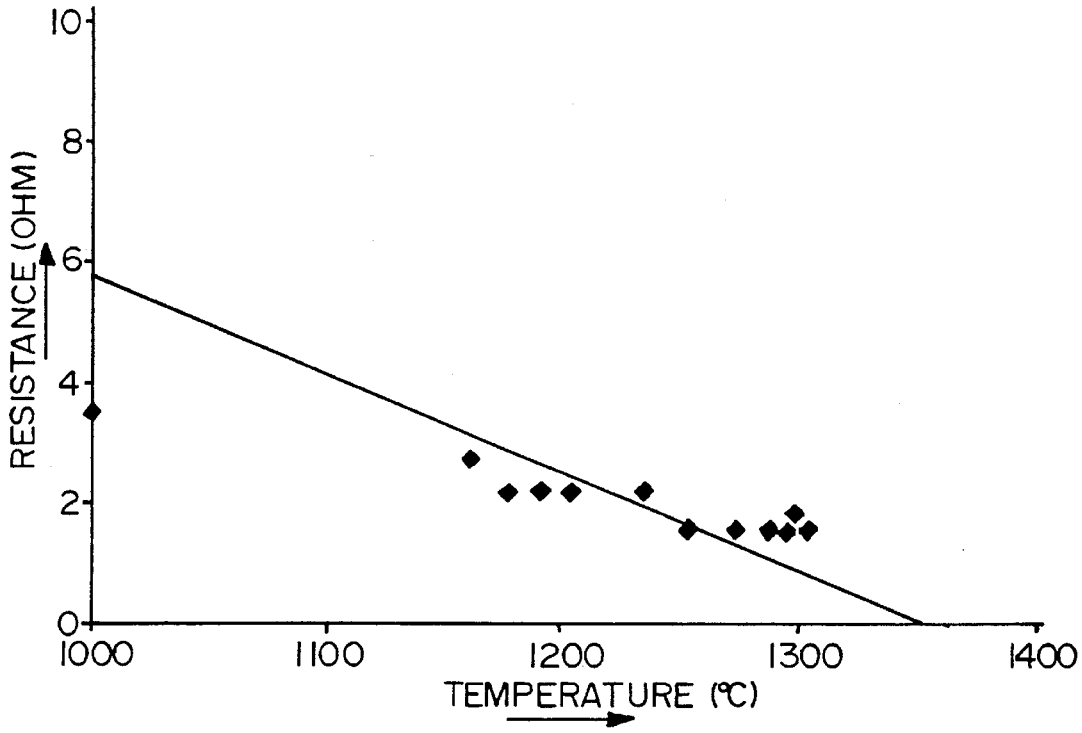
FIG. 5 shows a plot of resistance against temperature for the activated carbon whose power input is plotted in FIG. 3.

The furnace 10 was preheated by charging it with 4 kg of granular activated carbon and by applying a potential of 380 V between the electrodes 30 and 32. The carbon was heated under nitrogen and reached 1300° C. in 12 hours, heating being monitored to keep it at this temperature by means of a reduced potential for a further 5 hours to heat up the furnace lining to cause it to reach a steady state as regards temperature. The kiln was rotated at 1 rpm. FIG. 3 is a plot of power input against time for the furnace preheating, showing that power supply decreased after 1 hour. FIGS. 4 and 5 respectively show the change of electrical resistance of the activated carbon against time and against temperature of said carbon. In this regard it should be noted that, naturally, if desired, electrical preheating by means of heating elements embedded in the furnace lining or any other suitable pretreating can be used instead.

After the kiln was preheated rotation was stopped and the carbon was extracted under nitrogen, the 20 kg charge of limenite/duff coal then being loaded into the furnace under nitrogen. Rotation of the furnace was restarred immediately after this loading and the temperature of the charge rose rapidly to about 850° C. A potential of 220 V was applied as soon as rotation restarted, to heat the charge to 1300° C., with the potential being reduced whenever power input exceeded 22 kW. The operating temperature of 1300° C. was reached after 1 hour and was maintained for a further 3 hours by selectively altering the voltage of the potential applied to the electrodes 30, 32 to appropriate values to keep as close to 1300° C. as possible. The interior of the furnace was fed with nitrogen so that the charge was maintained .under nitrogen atmosphere, and so that the titanium in the charge became fully nitrided.

Figure 6:
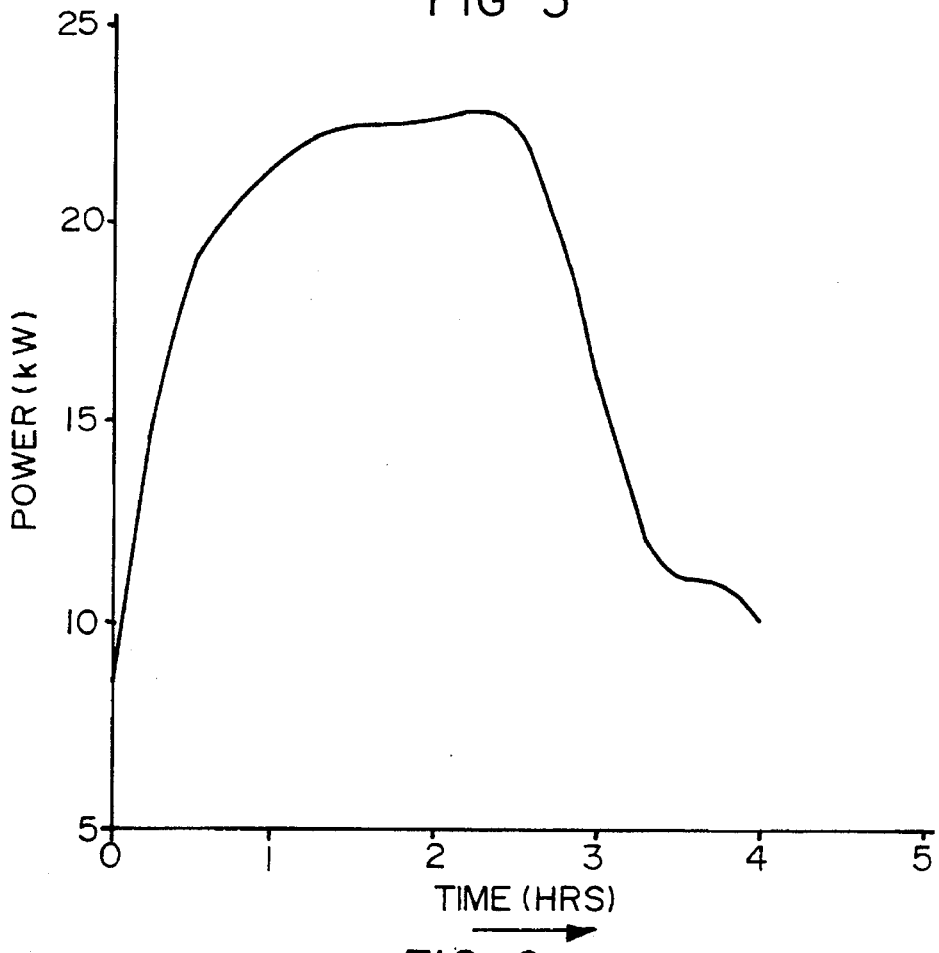
FIG. 6 shows a plot, similar to FIG. 3, for a mixture of ilmenite and duff coal.
Figure 7:
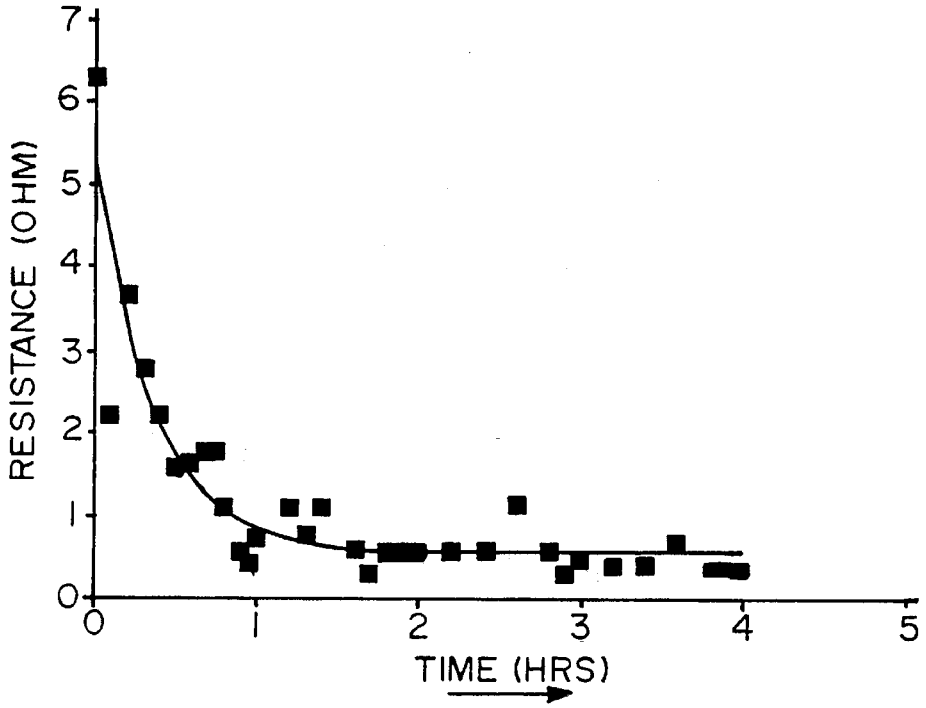
FIG. 7 shows a plot similar to FIG. 4 for the mixture of FIG. 6.
Figure 8:
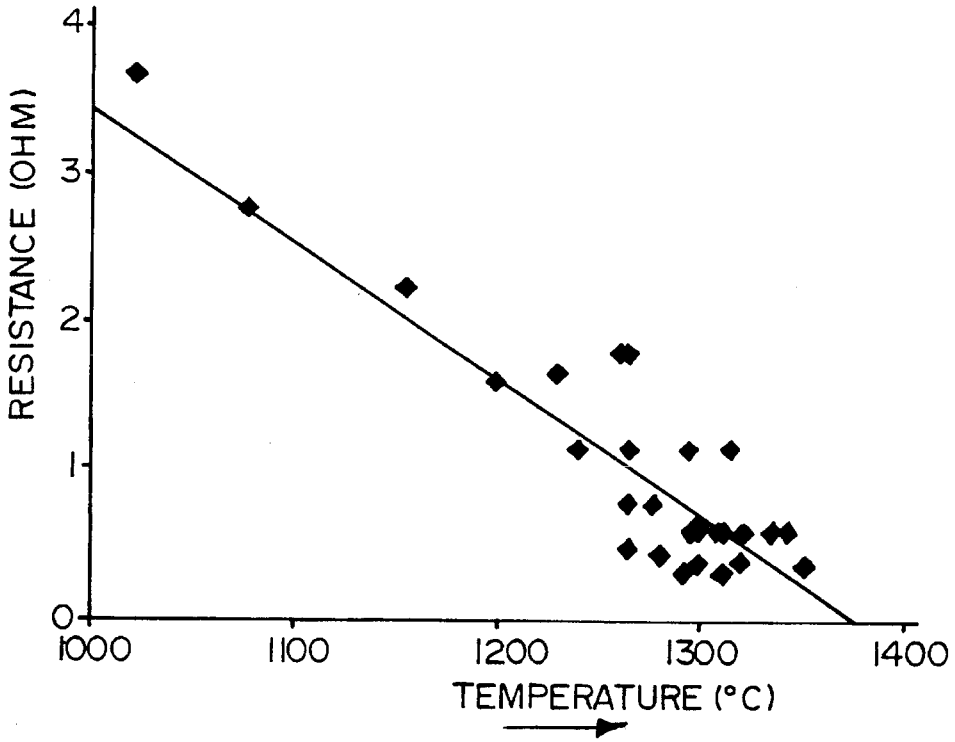
FIG. 8 shows a plot similar to FIG. 5 for the mixture of FIG. 6.

Maximum power input was not allowed to exceed 22 kW and temperature was not allowed to exceed 1300° C. to guard against thermal shock to the furnace lining and three input potentials were used after 1300° C. had been reached, namely 60 V, 110 V and 220 V. Power input for heating the charge is plotted in FIG. 6 against time; resistance of the charge is plotted in FIG. 7 against time; and resistance of the charge is plotted in FIG. 8 against temperature of the charge.

Kiln rotation was kept at 1 rpm and the nitrogen feed rate was 2,19 kg/hr, nitrogen feed being continuous, the nitrogen feed amounting to 3 times the stoichiometric requirement to nitride the titanium in the charge. After 3 hours of nitrogen feed the power supply was cut off and the furnace was allowed to cool naturally with constant rotation at 1 rpm with the charge under nitrogen. The charge was removed when the temperature dropped to under 400° C. In the nitrided charge >95% of the titanium was found to have been converted to non-stoichiometric titanium nitride. Similar results were obtained when Example 1 was repeated using the charge mixture in the form of (i) pellets of a 10 mm diameter, containing 2% by mass bentonite binder, although it was found that a substantial proportion of the pellets had disintegrated by the end of the test; (ii) briquettes having a size of 45 mm×20 mm×20 mm; and (iii) larger and smaller particles than the pellets and briquettes.

EXAMPLE 2

Example 1 was repeated using an 20 kg charge which was a mixture of titaniferous slag obtained from Highveld Steel and Vanadium Corporation (Proprietary) Limited mixed with duff coal in a proportion of 350 g coal/kg slag. This was double the stoichiometric amount of coal required completely to reduce the titanium (as the oxide) in the slag. The charge was pelletized using 2% by mass bentonite binder, into 10 mm diameter pellets.

The composition of this slag, and that of the ilmenite used for Example 1, are set forth in the following Table:

TABLE

Chemical Compositions of Titaniferous Slag and Ilmenite

| Constituent | Titaniferous Slag (mass %) | Ilmenite (mass %) |
|---|---|---|
| $TiO_2$ | 30.5 | 48.8 |
| $SiO_2$ | 20.75 | 1.3 |
| MgO | 14.10 | 1.0 |
| CaO | 16.8 | 0.04 |
| $Al_2O_3$ | 13.65 | 0.7 |
| $Cr_2O_3$ | 0.19 | <0.01 |
| FeO | 5.15 | 47.0 |
| $V_2O_3$ | 1.05 | 0.12 |
| MnO | 0.69 | 0.82 |

The $TiO_2$ in the, slag was present principally as fassaite [Ca(Ti,Mg,Al) $(Si,Al)_2O_6$], and perovskite [$CaTiO_3$], and to a lesser extent as pseudobrookite [$Fe_2O_3TiO_2$ and ulvospinel [$Fe_2TiO_4$].

The charge was heated to 1300° C. as soon as possible, power input being restricted to 20 kW to resist sintering the charge, and using a potential of 380 V. The operating temperature of 1300° C. was reached after 1,5 hours and was maintained thereafter for 3 hours by electrically applying potentials of 200 V or 110 V, as required. The nitrogen flow rate during the 3 hour reaction period was 0,4 kg/hr, which amounted to 4 times the stoichiometric requirement to nitride the titanium in the charge.

Figure 9:
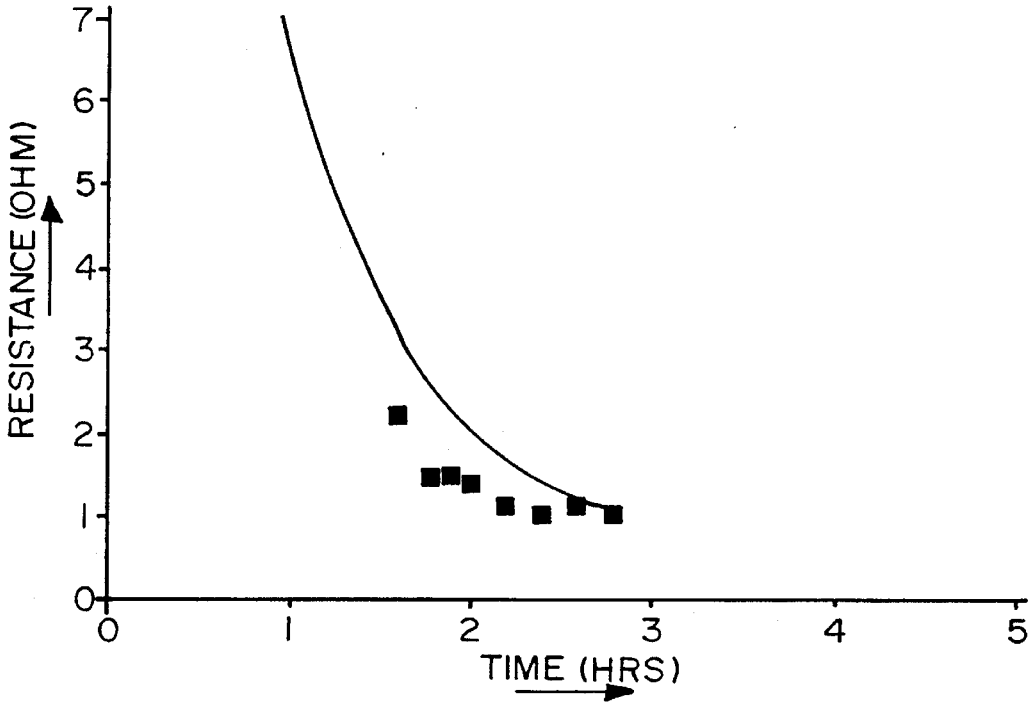
FIG. 9 shows a plot similar to FIG. 4 for a mixture of titaniferous slag and duff coal.
Figure 10:
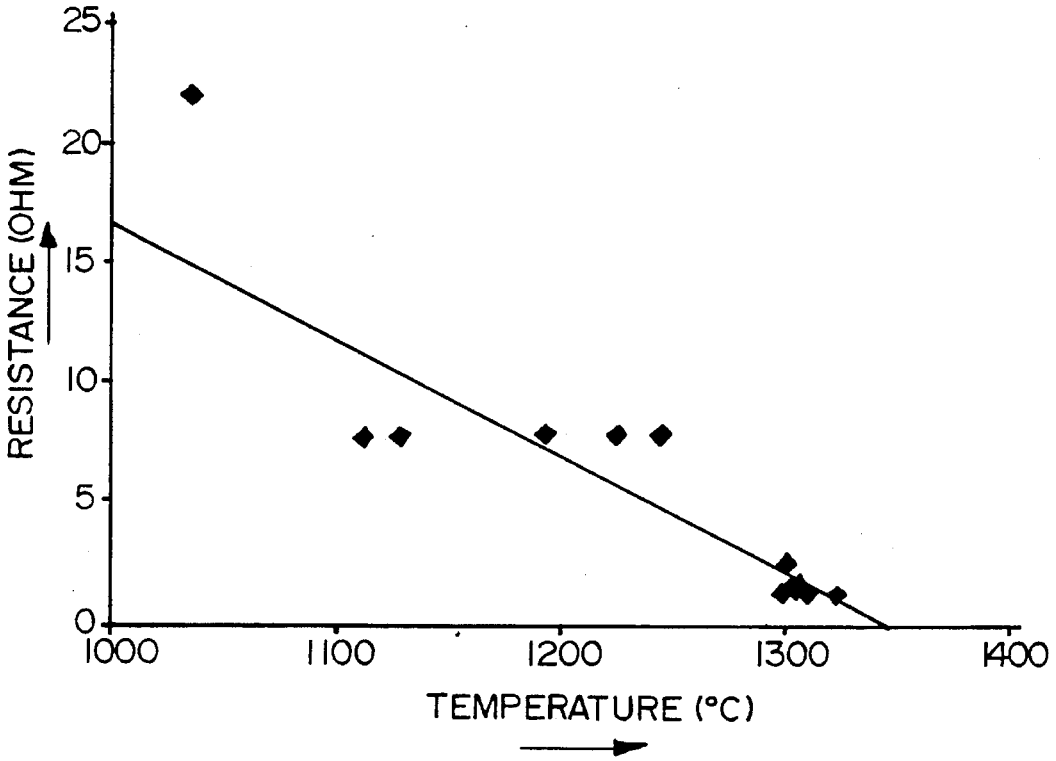
FIG. 10 shows a plot similar to FIG. 5 for the mixture of FIG. 9.
Figure 11:
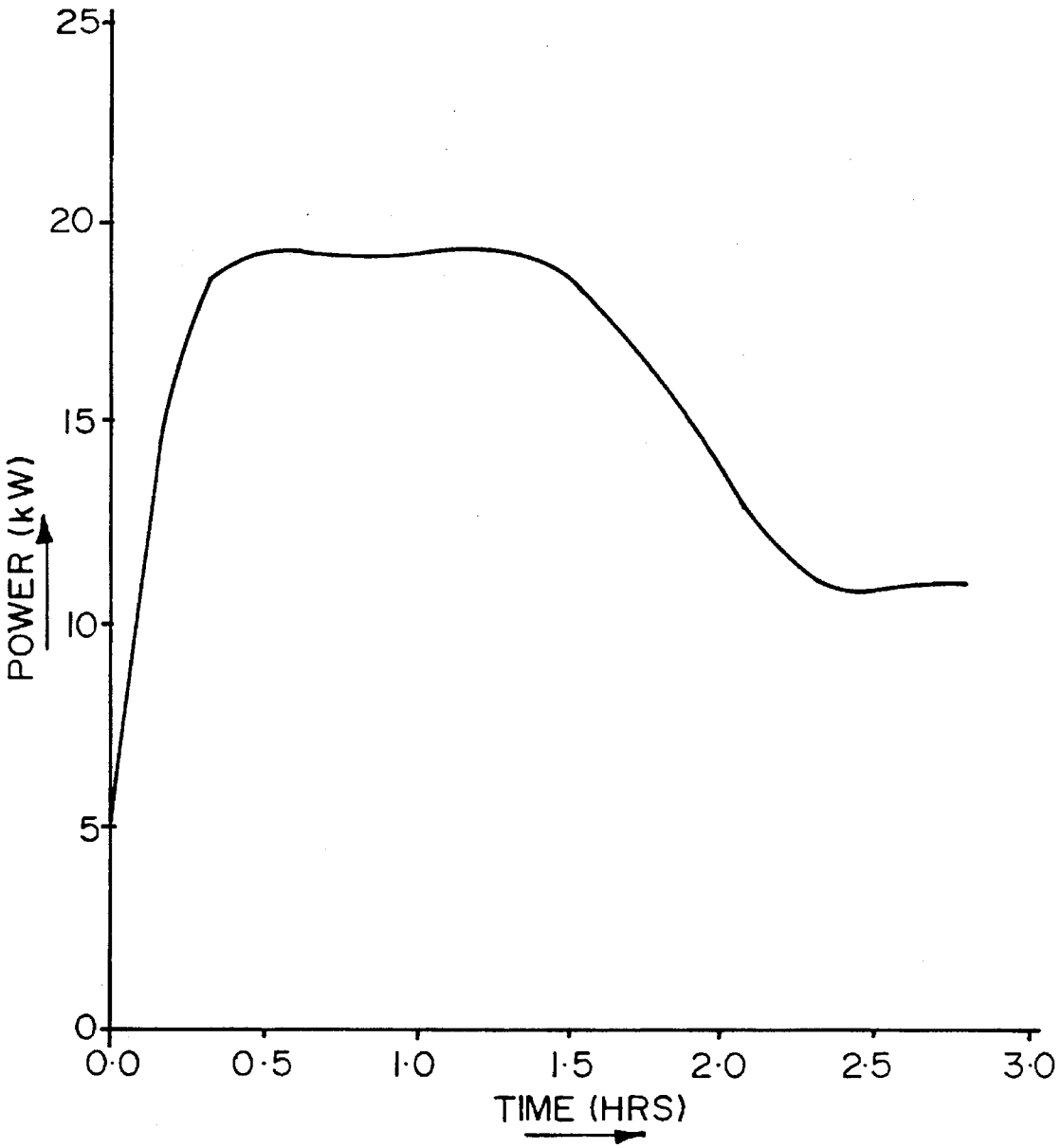
FIG. 11 shows a plot similar to FIG. 3 for the mixture of FIG. 9.

A conversion of >92% of the titanium in the charge to non-stoichiometric titanium nitride was achieved. FIG. 9 shows a plot of resistance of the charge against time; FIG. 10 shows a plot of resistance of the charge against the temperature thereof; and FIG. 11 shows power supply to the furnace plotted against time.

EXAMPLE 3

A metal oxide-carbon mixture was prepared by mixing 15,8 kg $V_2O_3$ with 4.2 kg pitch coke (consisting of 82,5% fixed carbon and 15,9% volatiles) and 0,4 kg stabilised polymer emulsion plus starch binder.

The mixture was formed into pellets, having a diameter of approximately 10 mm, on a disk pelletiser and cured. The expected chemical reaction was $$V_2O_3+3C+N_2=2VN+3CO.$$

The furnace 10 was pre-heated and loaded with the cured pellets as in Example 1. The charge was heated to 1350° C. in 5 hours and maintained at 1350° C. for 2 hours. Power input was restricted to 22 kW to prevent localised sintering of the charge. The potential difference settings applied across the electrodes 30, 32, in order to ensure sufficient power input, were limited to 60, 110, 220 and 380 V. The kiln was rotated at 1 rpm during the reaction, and a nitrogen flow rate of 2,19 kg/h was maintained during the procedure.

After reaction had been completed, the furnace was allowed to cool under nitrogen. The charge was unloaded at ambient temperature to prevent re-oxidation of the vanadium carbonitride product. The product, which was hard and dense and had a volume about one half of the original volume, contained contains 77,2% vanadium, 2,7% carbon, 17,6% nitrogen and 2,6% oxygen.

EXAMPLE 4

A metal oxide-carbon mixture was prepared by mixing 9,6 kg $SiO_2$ with 10,4 kg of carbon (precipitated from a coal solution by evaporating the solvent).

Briquettes having a size of 40 mm×23 mm×12 mm were prepared from the mixture by compressing at 1500 psi and curing at 230° C. The expected reaction is given by the equation $$SiO_2+3C=SiC+2CO$$

The furnace 10 was pre-heated and loaded with the cured briquettes as for Example 1. The charge was heated to 1500° C. over a period of 8 hours and maintained at 1500° C. for 9 hours. Power input was restricted to 25 kW to prevent localised sintering of the charge. The potential difference settings applied over the electrodes 30, 32, in order to ensure sufficient power input, were limited to 60, 110, 220 and 380 volts. The kiln was rotated at 1 rpm during the reaction, while an argon flow-rate of 10 l/min was maintained.

After the reaction, the furnace was allowed to cool 600° C. under argon. The charge was unloaded and cured at 600° C. for 10 hours to remove any excess carbon. After curing the product was found to consist of 100% SiC.

EXAMPLE 5

Eluted carbon from a gold extraction process, and having a moisture content of 42%, was loaded into the preheated furnace (800° C.) under nitrogen. Rotation was started immediately after loading, and voltage was applied across the bed of wet carbon. Typical voltages throughout the regeneration process ranged from 380 V–60 V as the resistivity of the carbon changed. Steam was emitted in the first five minutes of the process before regeneration as such commenced. The residence time of the carbon in the furnace was 20 minutes at a temperature of 720° C. This facilitated the driving off of the organics from the porous carbon thereby reactivating it and preparing the carbon for delivery to the adsorption section of the gold extraction plant.

The organics that are driven off the carbon during regeneration come from reagents added upstream of the elution process. These organics wastefully occupy sites on the carbon that extracted gold should occupy during adsorption, rendering the adsorption process inefficient.

When the residence time of 20 minutes hag been completed the carbon was discharged into a quench tank of water where it was cooled, and then pumped back to the adsorption section. Quenching the carbon inhibits oxidizing thereof and provides rapid cooling.

Figure 2:
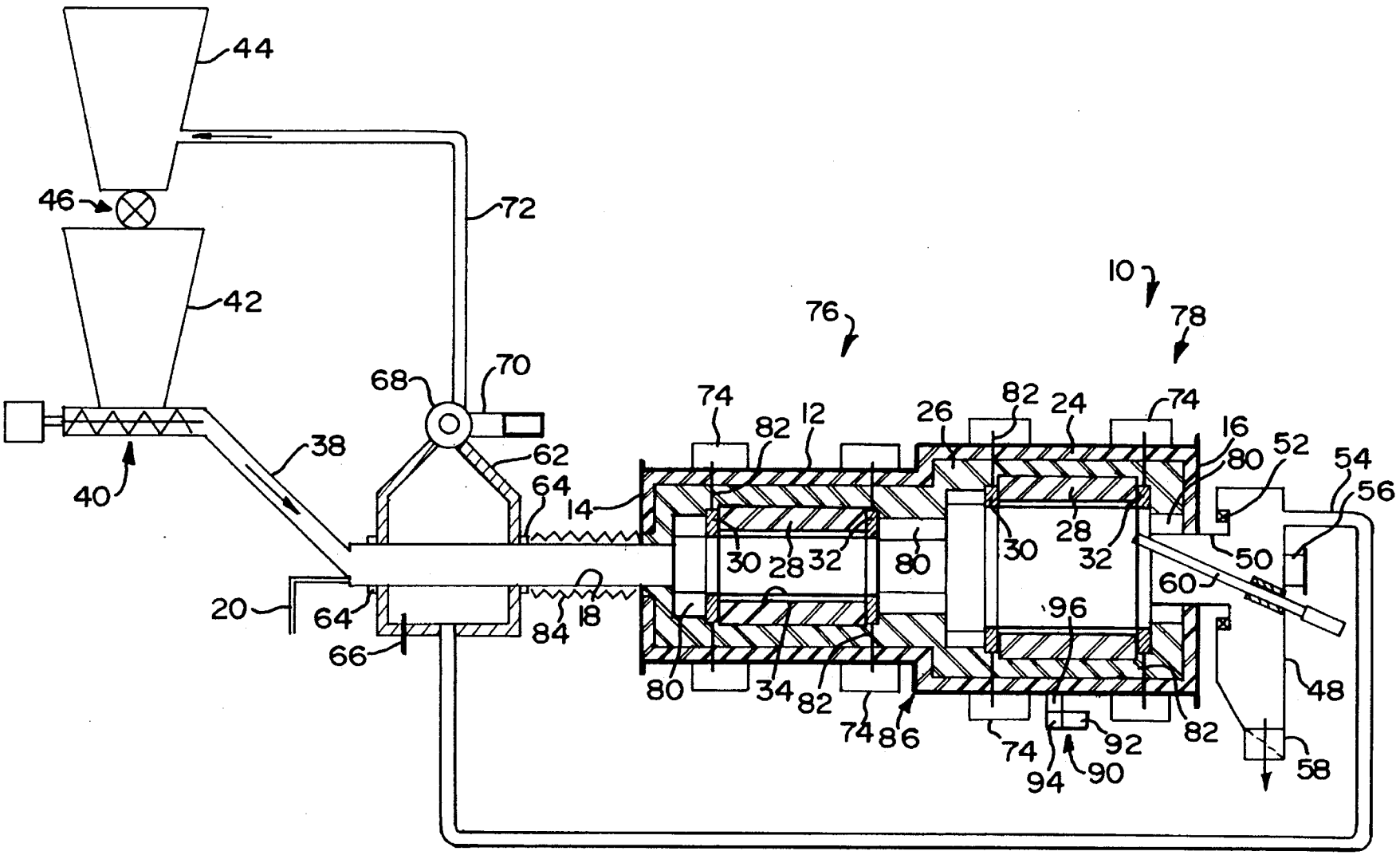
FIG. 2 shows a view, similar to FIG. 1, of a furnace according to a second embodiment of the invention.

Referring to FIG. 2, a furnace in accordance with a second embodiment of the invention is also generally designated 10. The furnace 10 of FIG. 2 is, in contrast to that of FIG. 1, intended for continuous operation and is also operable by means of an AC power supply.

Accordingly, the end of the feed passage 18 remote from the wall 12 is fed by a solids feed chute 38 which is supplied by a worm feeder 40 for extracting feed pellets from a pellet supply hopper 42. The hopper 42 is in turn fed from a pellet drying hopper 44 by a rotary star feeder 46.

The central opening of the end plate 16 forms an outlet for the furnace 10 and is provided with a hood 48 sealed to an outlet passage 50 protruding from said central opening by a circumferentially extending bearing seal 52. The hood 48 has an off-gas outlet duct 54 extending to a combustion chamber (described hereunder). The hood 48 also has a sight glass 56, a solids discharge device 58 and an adjustable chute 60. The chute 60, when the furnace is in steady-state operation, allows the flow issuing from the furnace via solids discharge device 58 temporarily to be increased, when desired.

The duct 54 extends to a combustion chamber 62 enclosing the upstream end of the passage 18, which chamber is sealed to said passage 18 by annular bearing seals 64. The chamber 62 has a pilot burner 66 and an outlet provided with an extraction fan 68 and a flow control slide valve 70. A gas duct 72 leads from the fan 68 to the drying hopper 44.

In FIG. 2, the slip rings 36 of FIG. 1 are omitted and replaced by electrode connection boxes 74. The hinged door 22 and spigot 23 of FIG. 1 are also omitted from FIG. 2.

A particular feature of the furnace 10 of FIG. 2 is that it comprises two axially aligned portions or segments, namely an upstream portion 76 of relatively reduced diameter and a downstream portion 78 of relatively increased diameter. Each portion 76, 78 has a pair of graphite electrodes 30, 32 spaced apart by 500 mm, and each portion 76, 78 is of broadly similar construction to the furnace 10 of FIG. 1.

In each portion 76, 78, the inner surface of the lining 26, upstream of the first electrode 30 and downstream of the second electrode 32, is provided with a plurality of axially extending circumferentially spaced extractor bars or ribs 80, standing radially inwardly proud of the inner surface of the lining 26, for keeping solids in the furnace 10 in motion as it rotates and for assisting in moving the solids axially through the furnace.

The connection boxes 74 are arranged in four rings around the furnace shell 12, each ring comprising four equally circumferentially spaced boxes 74 mounted on the shell 12. Each box is connected by an electrically insulated electrical lead 82 leading to the associated electrode 30 or 32 as the case may be. The boxes serve to connect the electrodes 30, 32 by means of slip rings (not shown) to an AC power supply (not shown).

An electrical preheater 84 is shown enclosing the downstream portion of the passage 18.

A feature of the furnace 10 of FIG. 2 is that the increase in diameter from the portion 76 to the portion 78, which is in the form of a step in diameter at 84, promotes electrical isolation of the electrode 32 of the portion 76 from the electrode 30 of the portion 78, by causing a break or discontinuity, in use, between solids in the portion 76 and solids in the portion 78, so that there are separate beds of solids in the portions 76, 78, which beds do not merge into each other. In other words, there is a damming effect in each portion or segment, so that each portion can be operated and controlled, e.g. as regards applied voltages and residence times, substantially independently of each other.

The operation of the furnace 10 of FIG. 2 will be essentially similar to that of the furnace of FIG. 1, but on a continuous rather than a batch basis. Thus, optionally, after preheating the furnace 10 using granular activated carbon fed through the furnace under nitrogen while applying a suitable voltage until the interior of the furnace is at a steady state temperature of 1300° C., feed of a pelleted reaction mixture, similar to those of Examples 1 or 2, can be started.

Pellets are fed from hopper 44 by feeder 46 to hopper 42 and thence they are fed by feeder 40 via chute 38 into passage 18. In passage 18 they are heated by the electrical heater 84. As the pellets pass through the rotating portions 76 and 78 they are heated by electrical currents flowing through the pellets between the electrodes 30, 32 of each portion 76, 78. Suitable potentials (e.g. Examples 1 and 2) are applied to the electrodes 30, 32 to maintain pellet temperature at 1300° C. and nitrogen at a suitable stoichiometric rate (see Examples 1 and 2) is fed into the furnace along duct 20. The pellet feed rate is selected such that the pellets have a residence time of 3 hours in the furnace at 1300° C.

Off-gas from the pellets in the furnace is ducted along duct 54 by fan 68 to combustion chamber 62 where it is ignited by pilot burner 66. Heat from the burning off-gas assists in preheating the pellets before they enter the furnace 10, and combustion gas from the chamber 62 is fed along duct 72 by fan 68 to hopper 44 where it dries the pellets.

Product is extracted from hood 48 via discharge device 58 and can be sampled by means of the adjustable sampling chute 60. The reaction in the furnace can be monitored visually by means of the sight glass 56, and the temperature at various places in the furnace can be monitored by means of suitably located thermocouples (not shown). The connection boxes 74 are used to feed current via the leads 82 to the electrodes 30, 32 as required, and are used to receive inputs from the thermocouples and to transmit them to external monitoring devices (not shown).

A particular feature of the invention, as demonstrated with reference to the Figures, is that constant motion of the solids charge in the furnace continually disrupts the paths of electrical discharges between the electrodes 30 and 32, new discharge paths continually being established. Local overheating of the charge is avoided (as could take place in a fixed bed) and mixing of the charge promotes an even temperature thereof.

Figure 12:
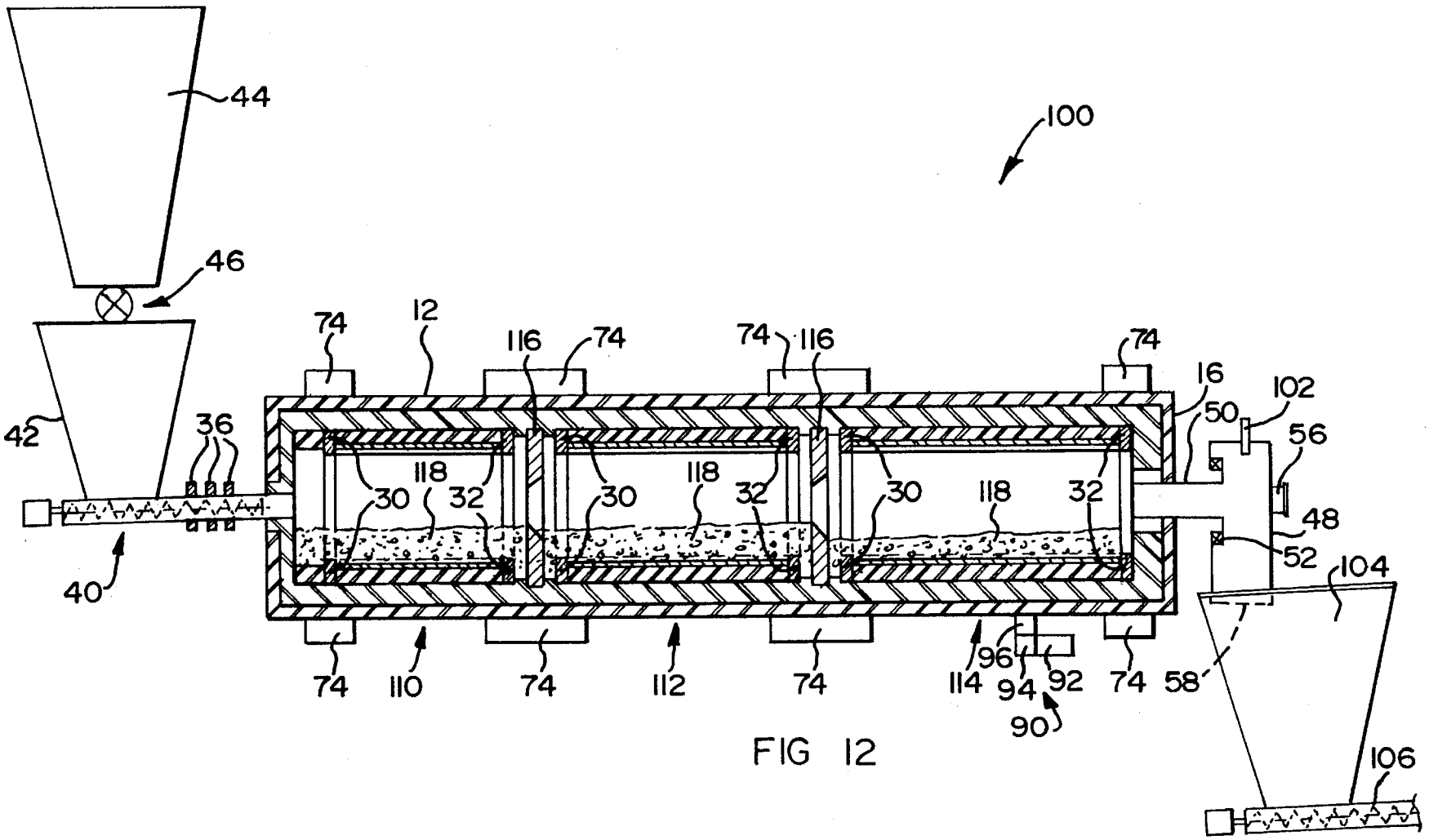
FIG. 12 shows a view, similar to FIGS. 1 and 2, of a furnace according to a third embodiment of the invention.

Referring now to FIG. 12, reference numeral 100 generally indicates a third embodiment of a rotary continuous operation furnace in accordance with the present invention. The furnace 100 generally resembles the furnace 10 of FIG. 2.

The furnace 100 differs from the furnace 10 of FIG. 2 in that it lacks the solids feed chute 38 and, instead, the worm feeder 40 feeds feed material directly into the furnace. Further, instead of the off-gas outlet duct 54 and the combustion chamber 62, the hood 48 of the furnace 100 is provided with a burn-off burner 102. In this embodiment of the invention the solids discharge device 58 feeds directly into a sealed storage hopper 104 which is provided with a worm extractor 106 for discharging solid material. If desired, the storage hopper 104 can be provided with a suitable gas inlet (not shown) , e.g. if it is required to control the atmosphere in the hopper. The entire assembly from the worm feeder 40 to the worm extractor 106 is more or less gas tight.

The furnace 100 differs, further, from the furnace 10 of FIG. 2 in that it comprises three axially aligned portions or segments namely a first segment 110, a second segment 112 and a third segment 114, segment 110 being upstream of segment 112, and segment 112 being upstream of segment 114. The segments 110, 112 and 114 all have an internal diameter of 500 mm but differ in length. In addition, the distance between the electrodes 30, 32 of the first segment is 700 mm, that between the electrodes 30, 32 of the second segment is 910 mm, and that between the electrodes 30, 32 of the third segment is 1120 mm.

The first, second and third segments 110, 112, 114 are separated from one another by annular partitions, or orifice rings, of electrically insulating refractory bricks 116. The furnace 100 is further provided with lifting bare (not shown) adjacent the orifice rings 116 for transferring solid material 118 from one segment to the next as the furnace 100 rotates, through the central opening of the associated partition 116. The entire furnace is inclined at an angle of 2° to the horizontal to facilitate the passage of the solid material 118 through the furnace 100, whose downstream end is its lower end. The orifice rings 116 serve electrically to isolate the solid material 118 in one adjacent segment from solid material 118 in the other adjacent segment. The electrodes 30, 32 of the separate segments 110, 112, 114 are connected via the connection boxes 74 by electrical connectors (not shown) to a single three-phase source of electrical power, one phase being connected to each of the segments.

The construction of the furnace 100 takes advantage of the fact that the resistivity of the solid material 118 prepared according to the method of Example 1 described above, reduces as the material is heated and as reaction of the titanium and iron in the material proceeds so that although the distance between the electrodes 30, 32 of the third segment 114 is greater than that between the electrodes 30, 32 of the second segment 112, the same voltage can be used to achieve the same current flow in both segments. The same holds for the segments 112 and 110.

Figure 13:
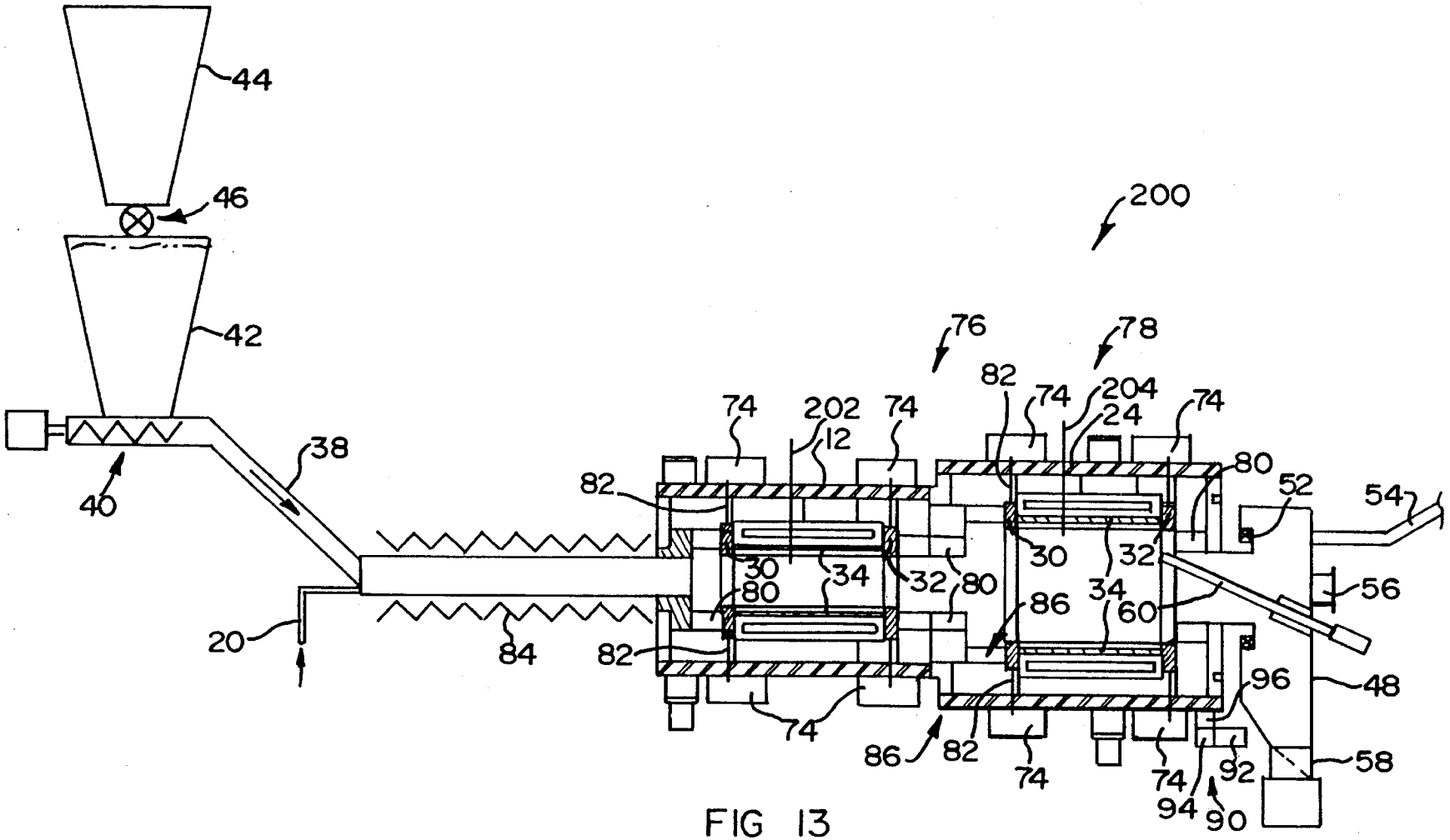
FIG. 13 shows a view, similar to FIGS. 1 and 2 of a furnace in accordance with a fourth embodiment of the invention.

Referring to FIG. 13, reference numeral 200 generally indicates a fourth embodiment of a rotary continuous-operation furnace in accordance with the present invention. The furnace 200 generally resembles the furnace 10 of FIG. 2.

The furnace 200 differs from the furnace 10 of FIG. 2 in that the combustion chamber 62 of the furnace 10 is absent in the furnace 200, the off-gas outlet duct 54 serving simply to vent the off-gasses. In this embodiment of the invention, the electrical pre-heater 84 alone serves to preheat the feed pellets and inlet gas. The furnace 200, further, includes thermocouples 202, 204 projecting, respectively, into the interior of the portions 76, 78. In this embodiment of the invention, there are three hoppers 44 (of which only one is shown in the drawing) each of 5–8 ton capacity for holding pellets or particulate materials. The hopper 42 is a 2 ton supply hopper. The overall length of the portions 76, 78 is 2,2 m.

Figure 14:
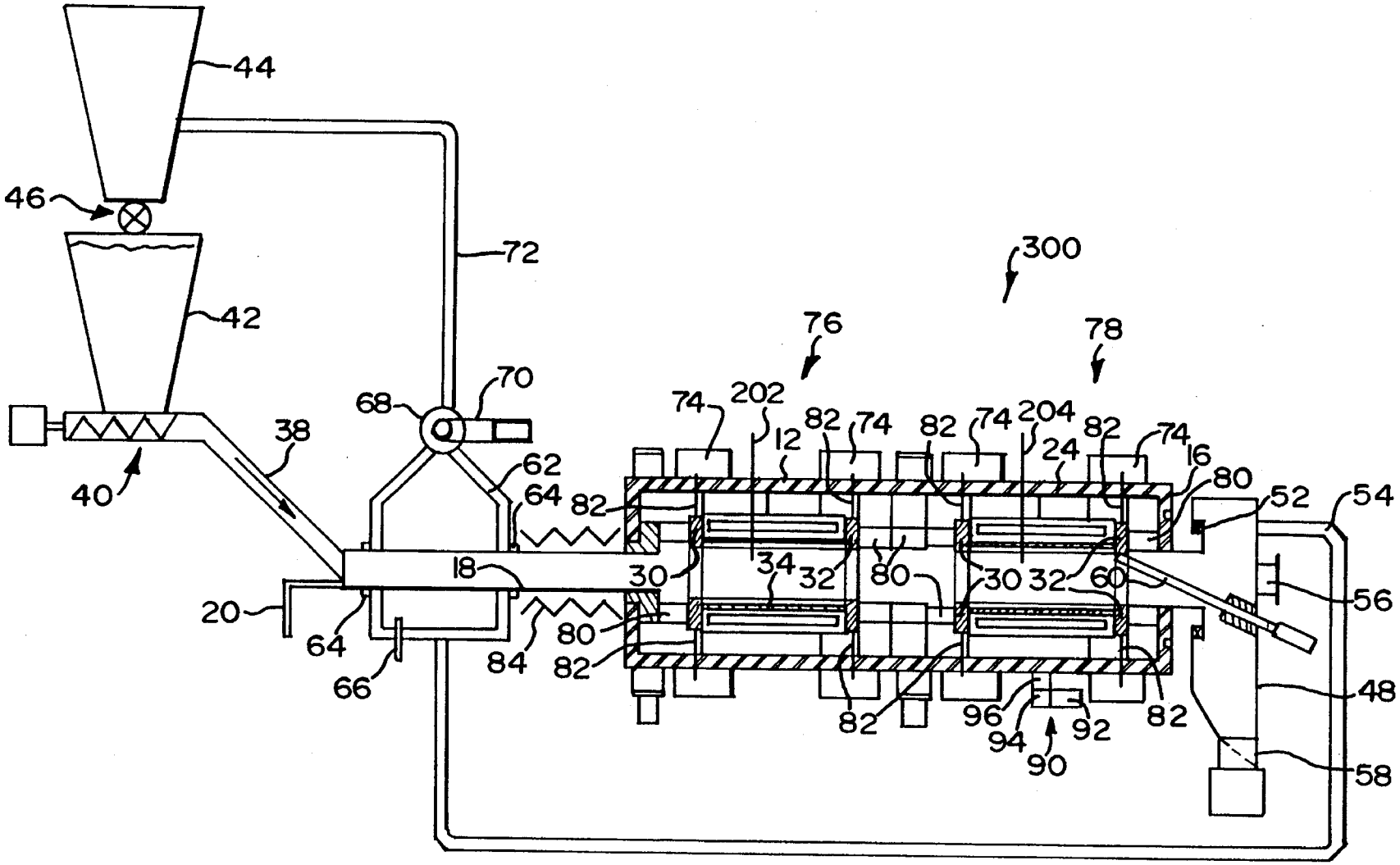
FIG. 14 shows a view, similar to FIGS. 1 and 2, of a furnace in accordance with a fifth embodiment of the invention.

Referring now to FIG. 14, reference numeral 300 generally indicates a fifth embodiment of a rotary continuous operation furnace in accordance with the invention. The furnace 300 generally resembles the furnace 10 of FIG. 2.

The furnace 300 differs from the furnace 10 of FIG. 2 only in that the portions or segments 76, 78 are of the same diameter so that the step 86 in diameter ie absent.

The capacity of the hoppers 42, 44 and the overall lengths of the portions 76, 78 are substantially the same as those of the furnace 200 of FIG. 13.

Figure 15:
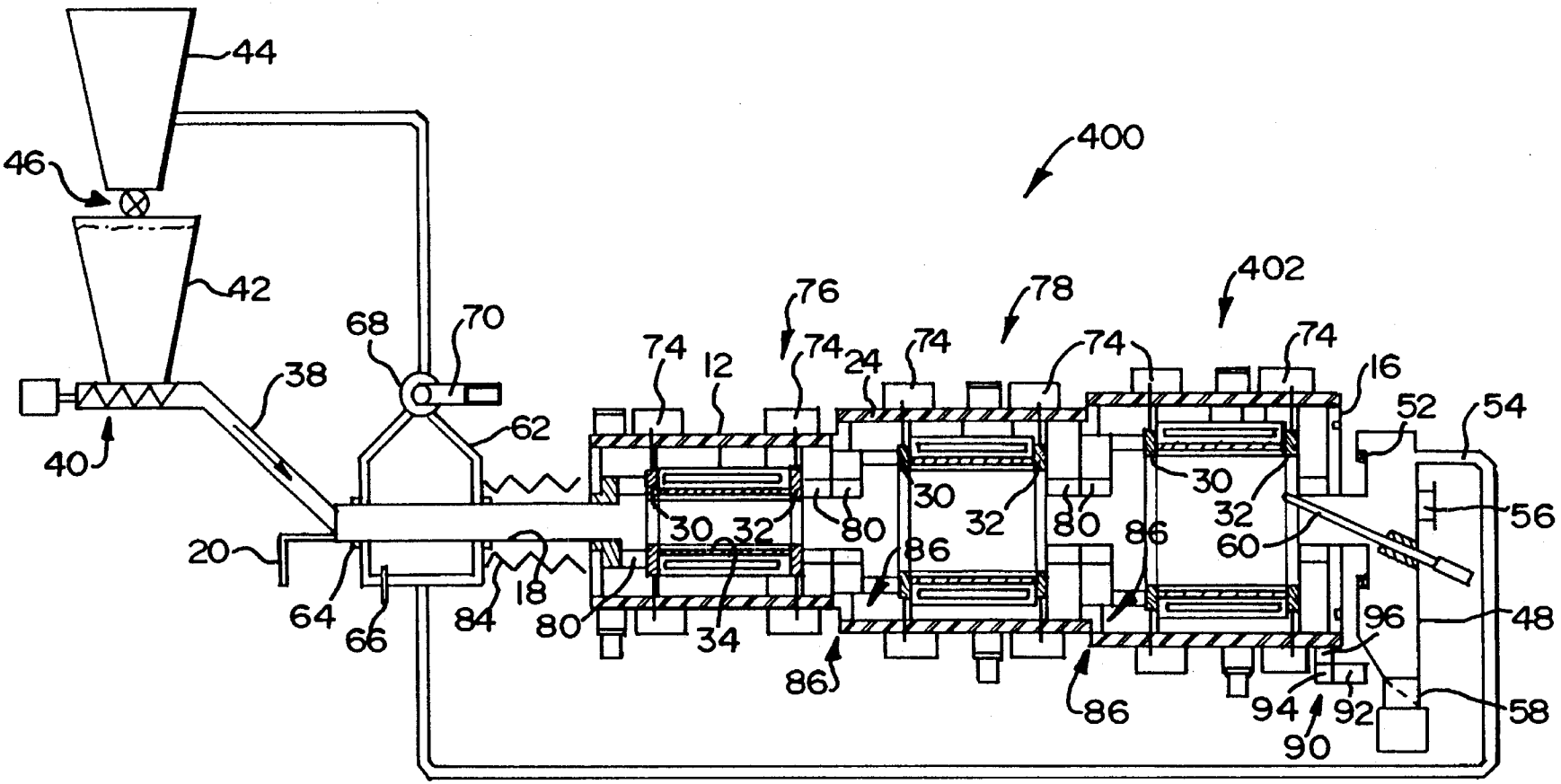
FIG. 15 shows a view, similar to FIGS. 1 and 2, of a furnace in accordance with a sixth embodiment of the invention.

Referring to FIG. 15, reference numeral 400 generally indicates a sixth embodiment of a furnace in accordance with the invention. Again, the furnace 400 resembles the furnace 10 of FIG. 2.

The furnace 400 differs from the furnace 10 of FIG. 2 in that it includes a further portion 402, in addition to the portions 76, 78. The portion 402 has a larger diameter than the portion 78 with a further step in diameter at 86 between the portions 78, 402. This step also serves to promote electrical isolation of the electrode 32 of the portion 78 from the electrode 30 of the portion 402, as described above, by a break in continuity between solids in the portion 78 and solids in the portion 402.

Referring to FIGS. 16–19, reference numeral 500 generally indicates a seventh embodiment of a continuous operation rotary furnace in accordance with the present invention.

The furnace 500 also has a hollow cylindrical outer mild steel wall 12, which is lined on its inner surface with a lining of insulating tiles 502 which lining is, in turn, internally lined by a layer of refractory concrete 504. The furnace 500 is DC operable.

Eighty four generally elongate porous or permeable plugs or distributors 506 of porous refractory material, e.g. silicon carbide, each having a generally square cross-section, and arranged in seven groups of twelve distributors 506 each, project inwardly from the wall 12. The distributors of each group are arranged in an annular fashion and are circumferentially spaced from each other as can be seen, in particular, in FIG. 18, and are aligned axially. The groups are axially spaced from each other as can be seen, in particular, in FIG. 16. Each distributor 506 is embedded in the linings 502, 504 with an inwardly directed face thereof flush with the inner surface of the refractory concrete lining 504.

Each distributor 506 is connected to a nitrogen inlet manifold 508, which is mounted to the furnace wall 12 and thus with the rotation of the furnace. Each manifold 508. has nitrogen inlet conduits 510 so that the axially aligned distributors 506 of each group are served by a single or common manifold 508. The manifolds 508 are in turn connected to a ring manifold 509 mounted to the wall 12. The ring manifold 509 slidingly abuts a stationary annular manifold component 511 so that the ring manifold 509 moves relative to the manifold component 511 as the wall 12 rotates. A conduit 513, connected to a nitrogen source (not shown) leads through the manifold component 511 at a low level. Thus, as one of the manifolds 508 comes into register with the conduit 513, nitrogen thus flows along that manifold, thereby to inject nitrogen sequentially only into those distributors 506 which are at their lowermost position during rotation of the furnace, so that the nitrogen passes into solid reagent material located at the bottom of the furnace chamber.

The furnace 500 includes riding rings 512. Unlike the furnaces 10, 100, 200, 300 and 400, the furnace 500 has twelve non-annular or elongate electrodes, arranged in three axially spaced groups 515, 517, 519 each comprising four electrodes. The electrodes of each group project radially inwardly and are spaced circumferentially from one another at angles of 90°. Each electrode has a generally square cross-section.

Figure 16:
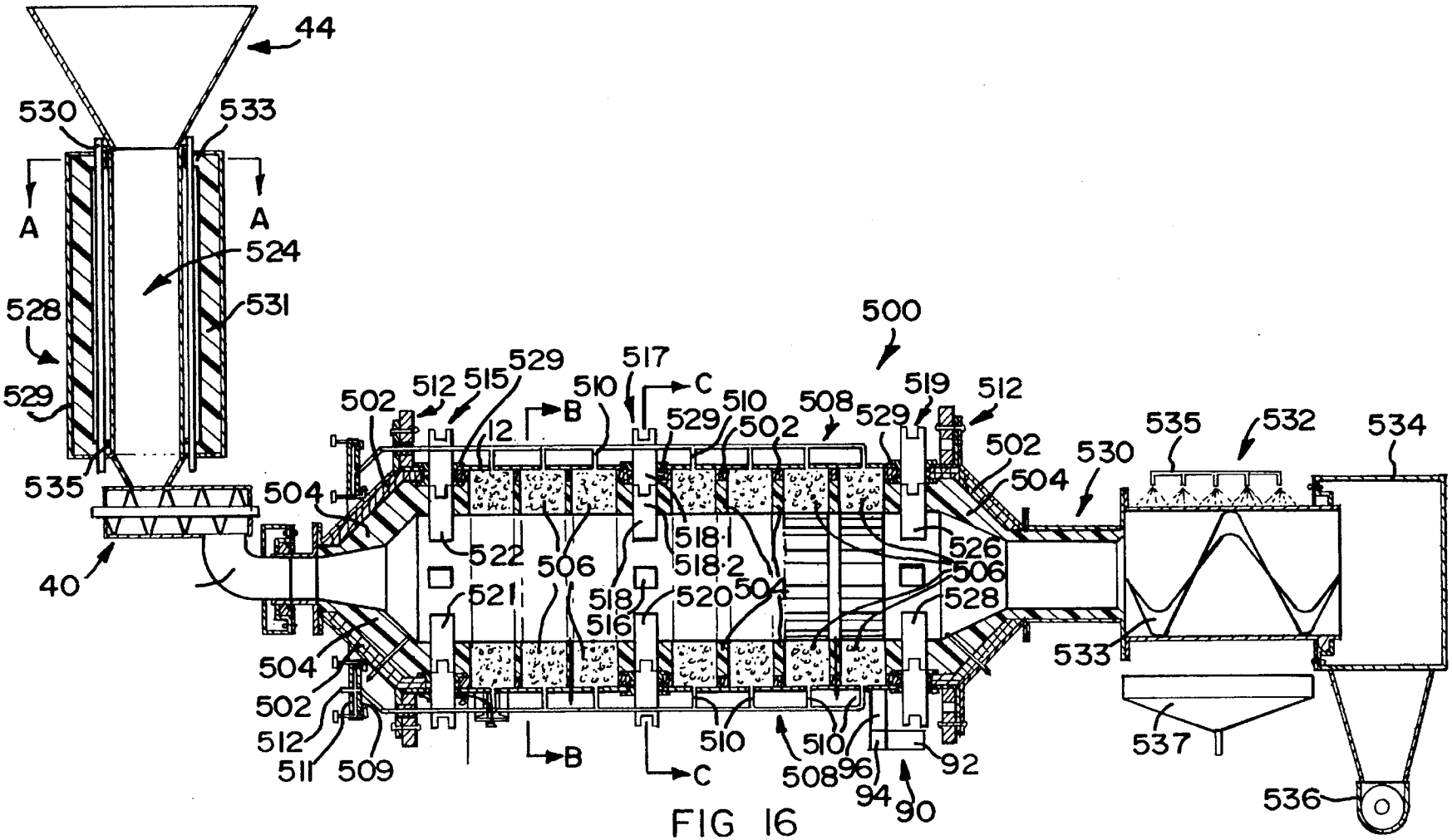
FIG. 16 shows a view, similar to FIGS. 1 and 2, of a furnace in accordance with a seventh embodiment of the invention, with some detail omitted for clarity.
Figure 17:
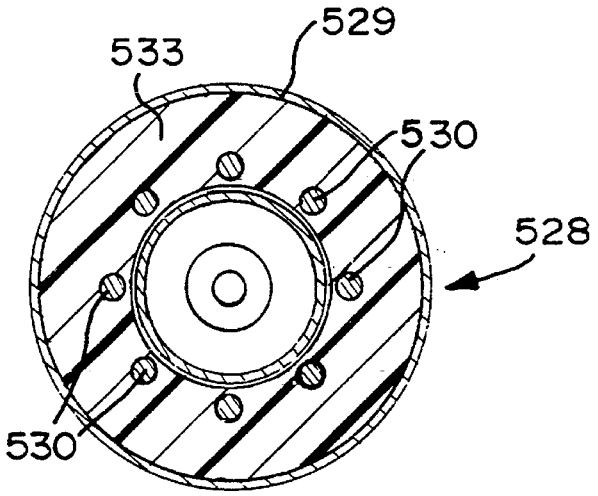
FIG. 17 shows a sectional view through A—A in FIG. 16, with some detail omitted for clarity.
Figure 19:
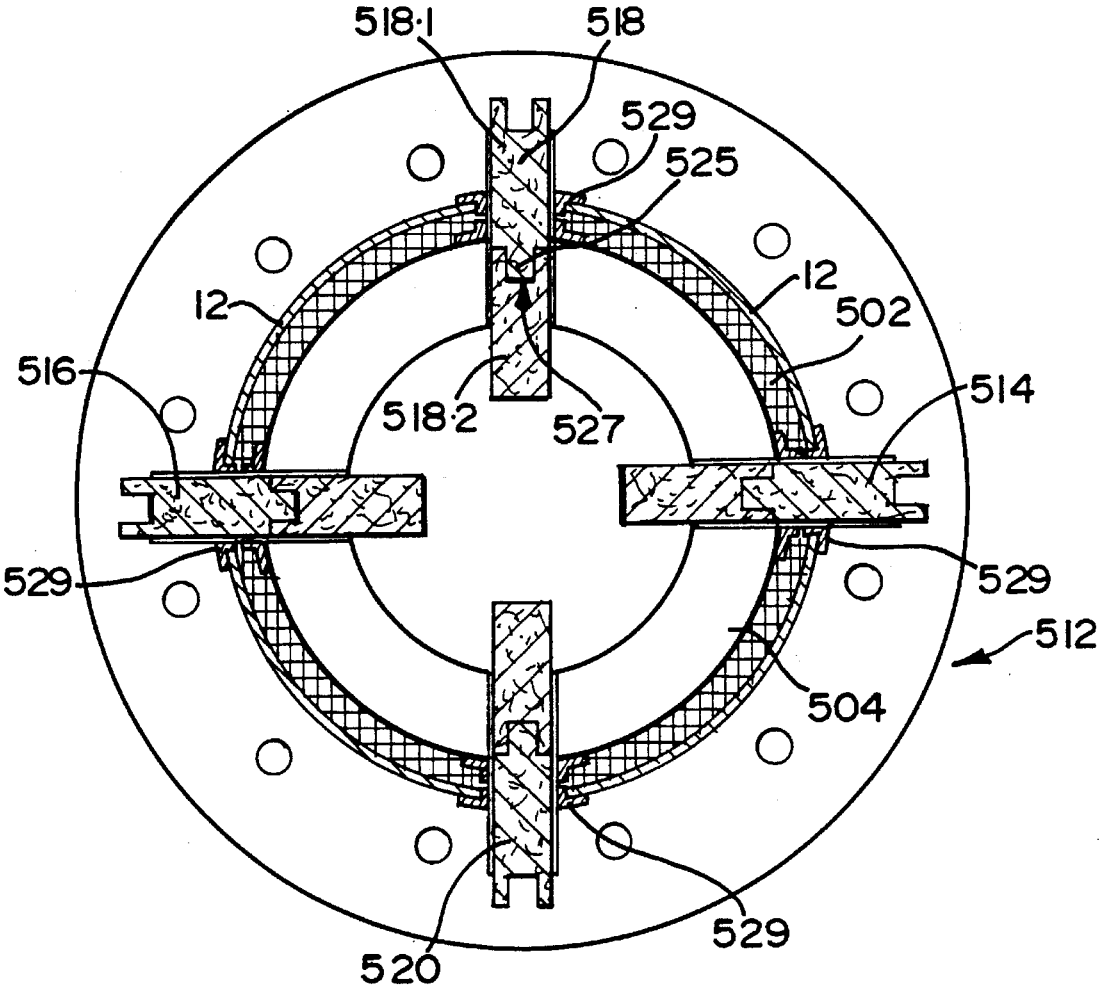
FIG. 19 shows a sectional view through C—C in FIG. 16, with some detail omitted for clarity.

FIG. 19 shows the four electrodes 514, 516, 518, 520 of the group 517 of electrodes. The group 515 of electrodes, of which only two 521, 522 can be seen in FIG. 16, is positioned near to the inlet end of the furnace 500 and the group 519 of which also only two electrodes 526, 528 can be seen in FIG. 16, is positioned near to the outlet end of the furnace. The third group 517 of electrodes 514, 516, 518, 520 (FIG. 19) is positioned near to the middle of the furnace 500. The electrodes in each group are aligned circumferentially while the electrodes of the three groups are aligned in the longitudinal direction.

Figure 18:
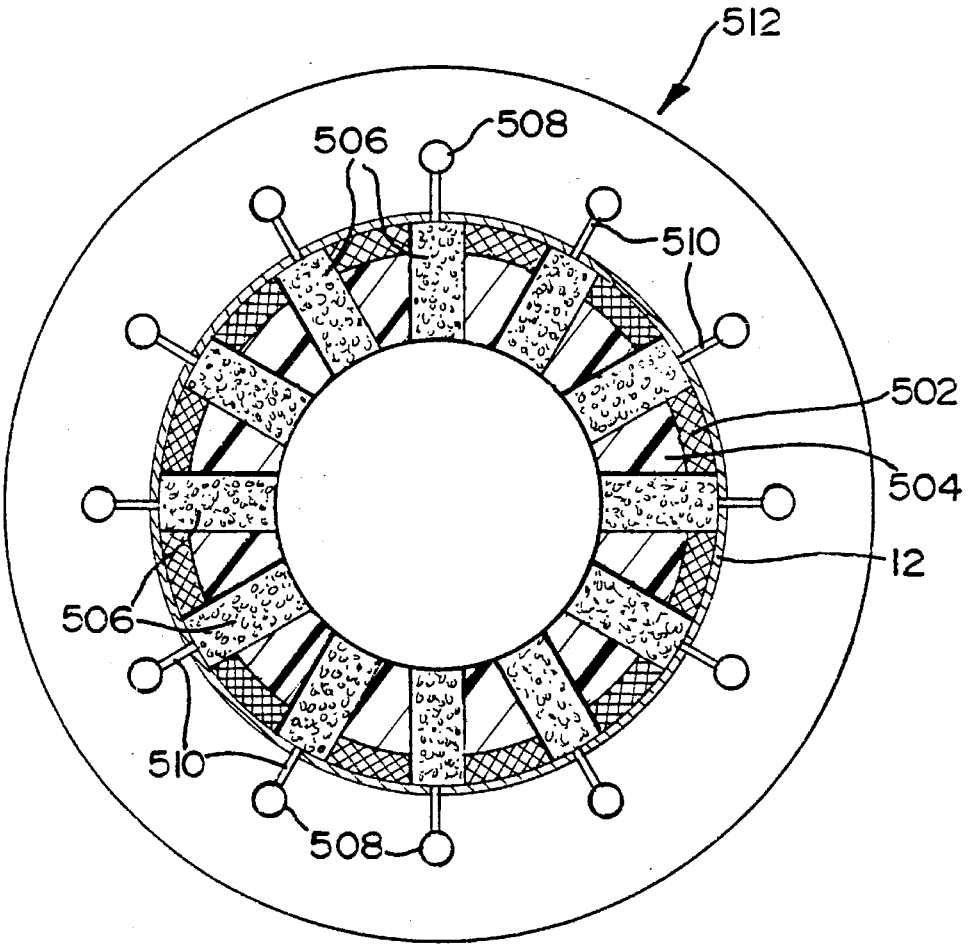
FIG. 18 shows a sectional view through B—B in FIG. 16, with some detail omitted for clarity.

Each electrode has an inner end which stands inwardly radially proud of the refractory concrete lining, as can be seen in FIGS. 16 and 18, and each is mounted in a mounting bracket 529.

Each electrode comprises two parts engaged with one another spigot and socket fashion. By way of illustration, the electrode 518 consists of an outer part 518.1 and an inner part 518.2, the outer part 518.1 having a spigot portion 525 which is engaged, by a friction fit, with a socket portion 527 in the inner part 518.2. Thus, as the inner part 518.2 is abraded away during use, the outer part 518.1 is pushed progressively inwardly until it eventually replaces the inner part 518.2 and a further outer part 518.1 is inserted behind it. In this way the electrodes of the furnace 500 are continuously replaced.

As mentioned hereinbefore, the furnace 500 is powered by a DC electrical supply. Thus, the group 517 of electrodes is maintained at a negative polarity, while the groups 515, 519 of electrodes are maintained at positive polarity so that current flow is towards the central group 517. The potential difference between the group 517 and the groups 515, 519 will depend on the material with which the furnace 500 has been charged and the process taking place and, in the case of nitriding ilmenite in order to recover titanium will typically be 350–500 volts.

The furnace 500, further, includes a feed chute 522 which is supplied by a worm feeder, or feed scroll, 40 for extracting pellets from a pellet supply hopper 44. A lower portion 524 of the hopper 44 which is circular cylindrical in shape is surrounded by a cylindrical shell 528 of refractory concrete in a mild steel casing 529. The shell 528 has walls 531 and upper and lower inwardly directed annular portions 533, 535 between which extend eight cylindrical silicon carbide electrodes 530 in a circumferentially spaced symmetrical arrangement. The shell 528 and electrodes 530 act as a shaft-type pre-heater for the material in the lower portion 524 of the hopper 44, and, in use, serves to pre-heat the material passing through the lower portion 524 to a temperature of about 800° C. The off-gases from the furnace can, optionally, be directed to atmosphere In a counter current direction to the material in the feed scroll 40, via the walls of the feed scroll 40 to ensure sustained pre-heating of the material fed into the furnace.

The furnace 500, further, has an outlet 530 leading to a cooler 532 provided with a worm screw 533, a water sprayer 535 and a sump 537. The worm screw 533 feeds cooled product into a discharge chute 534 provided with a screw conveyor 536 which removes the material when it has reached a temperature below 200° C.

Figure 20:
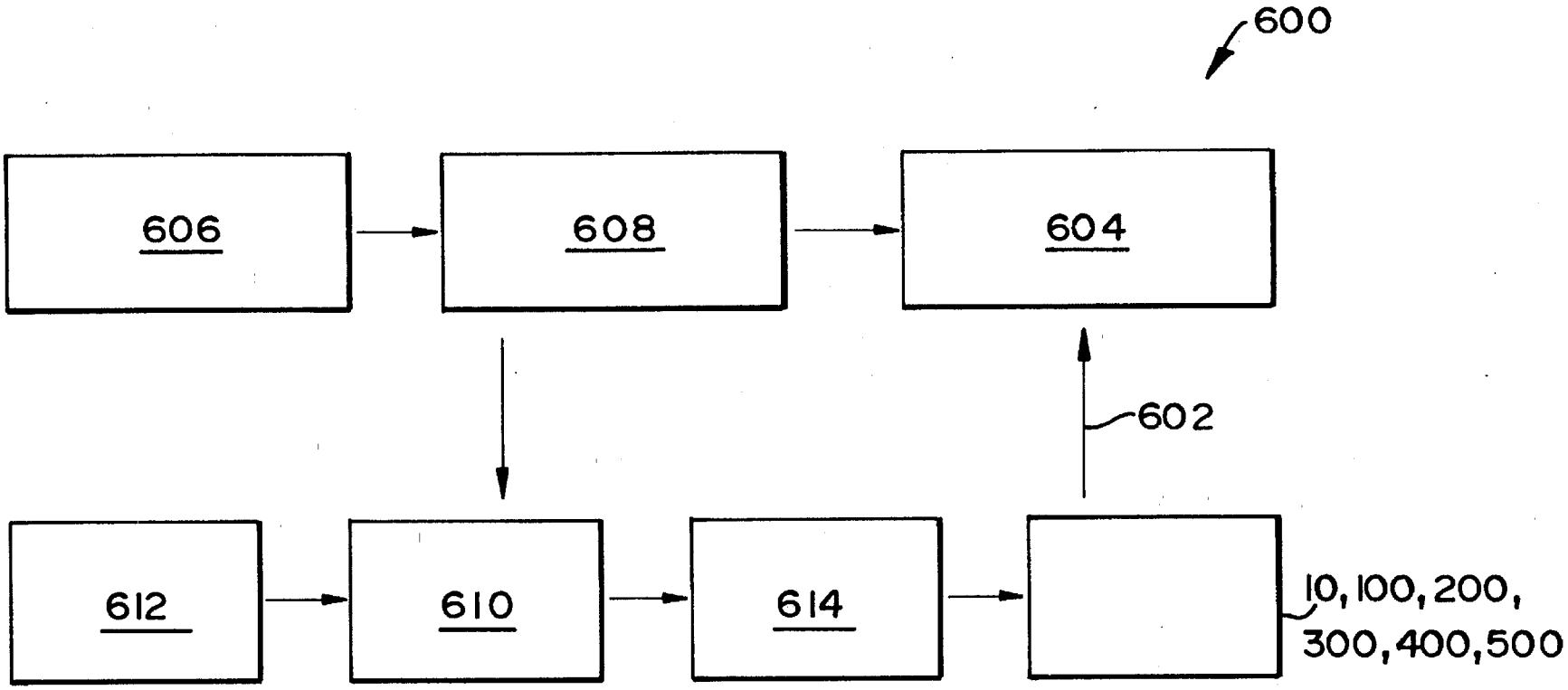
FIG. 20 shows, schematically, a representation of a power control system for controlling power to two successive portions of a furnace according to the invention.

Referring to FIG. 20, a control system 600 for the furnaces operates primarily on feedback 602 from the thermocouple readings in the furnace, which provided measured values 604. Set values 606 for power and temperature are supplied to a control instrument 608, which receives also the measured value 604. The control instrument 608 is connected to two thyristor drives 610 in series, each driving a separate furnace segment. Naturally, a greater number of the drives will be provided if there are a greater number of individually driven furnace segments. The thyristors are driven by independent transformers 612, delta connected on the secondary side of each transformer, The thyristors 610 are connected to the furnaces by means of transformers 614.

The furnaces 10, 100, 200, 300, 400 and 500 include suitable drive means 90 for driving the furnace shells to rotate. The drive means may include an AC electric motor and reduction-gear box 94 with variable speed drive, together with, for smaller furnaces, a chain and sprocket mechanism 96 for driving the casing to rotate, or, for larger furnaces, spur gears or driven support rollers 96 for driving the shell or casing to rotate.

We claim:

1. A furnace comprising:

a first cylindrical furnace shell rotatable about a rotational axis, the first furnace shell providing a first furnace chamber for holding a bed of solid particulate reagent as the first furnace shell rotates; and first and second electrodes exposed to the first furnace chamber and being electrically insulated from the furnace shell, with the electrodes being spaced apart so that the solid particulate reagent in the first furnace chamber is heated up by direct resistance heating thereof, utilizing the electrodes; and a second cylindrical furnace shell rotatable about the rotational axis and spaced axially from the first furnace shell, the second furnace shell providing a second furnace chamber which is in communication with the first furnace chamber and through which the solid particulate reagent from the first chamber passes in a longitudinal direction which is parallel to the rotational axis, and third and fourth electrodes exposed to the second furnace chamber and being electrically insulated from the furnace shell, with the third and fourth electrodes being spaced apart so that the solid particulate reagent in the second furnace chamber is heated by direct resistance heating thereof, utilizing the third and fourth electrodes.

2. A furnace comprising:

a furnace shell rotatable about a rotational axis, the furnace shell having a first segment and a second segment;

said first segment having a first furnace chamber for holding a solid particulate reagent;

said second segment having a second furnace chamber which is in communication with said first furnace chamber such that said reagent from said first chamber may pass to said second chamber: and a pair of electrodes in each chamber adapted to heat said reagent held in that furnace chamber by direct resistance heating said electrodes in each chamber being electrically insulated from said furnace shell.

3. A furnace as claimed in claim 1, in which each of the electrodes in each furnace chamber is of annular form and extends circumferentially along an inner surface of the furnace shell while protruding radially inwardly therefrom, with the electrodes in each of the chambers being spaced axially apart.

4. A furnace as claimed in claim 1, wherein one of the electrodes in each of the chambers extends centrally along the rotational axis, and wherein the other electrodes in each of the chambers each comprises a plurality of electrodes being spaced circumferentially from one another, each said plurality of electrodes protruding from and extending along an inner surface of the furnace shell in a longitudinal direction which is parallel to the rotational axis.

5. A furnace as claimed in claim 1, wherein the electrodes in each of the chambers protrude from and extend along an inner surface of the furnace shell in a longitudinal direction which is parallel to the rotational axis, with the electrodes in each of the chambers being circumferentially spaced from each other.

6. A furnace as claimed in claim 1, wherein the electrodes in each of the chambers are of non-annular form, and protrude from an inner surface of the furnace shell, with the first and third electrodes being spaced in a longitudinal direction which is parallel to the rotational axis, from the second and fourth electrodes, respectively.

7. A furnace as claimed in claim 6, wherein said first and third electrodes are each comprised of a plurality of electrodes, circumferentially aligned and spaced apart circumferentially, and being of the same polarity, and wherein said second and fourth electrodes are each comprised of a plurality of electrodes, circumferentially aligned and spaced apart circumferentially, and being of the same polarity which is different than the polarity of the first and third electrodes.

8. A furnace as claimed in claim 1, in which the first and second furnace chambers have equal diameters.

9. A furnace as claimed in claim 8, in which the first and second furnace shells are of the same length, and in which the first and second electrodes of the first furnace chamber are spaced a different distance apart to the third and fourth electrodes of the second furnace chamber.

10. A furnace as claimed in claim 1, in which each furnace shell comprises an outer skin, and an inner lining of a non-porous material against the outer skin.

11. A furnace as claimed in claim 10, in which the non-porous material is α-alumina.

12. A furnace as claimed in claim 1, which includes an annular isolating partition between the first and second furnace chambers for effecting the electrical isolation of the solid reagent in the one chamber from the other chamber.

13. A furnace as claimed in claim 1, in which the furnace chambers are closed off from the atmosphere, and which includes feed and extraction means for feeding and extracting solid reagent and waste product respectively therefrom, and gas feed means and gas extraction means for feeding gas into and withdrawing gas from the chamber respectively.

14. A furnace as claimed in claim 13, wherein the gas feed means includes a plurality of gas permeable distributors in the furnace shell, the distributors being circumferentially spaced from one another; gas delivery means for delivering gas to outer surfaces of the distributors, with the gas passing through the distributors into the furnace chamber; and gas flow control means operable, during rotation of the furnace, to deliver gas only to those distributors which are at or near the bottom of the furnace so that, in use, inflowing gas passes largely through a charge of solid particulate reagent in the furnace chamber.

15. A furnace comprising:

a cylindrical furnace shell rotatable about a rotational axis, the furnace shell having a first segment and a second segment, said first segment having a first furnace chamber for holding a reagent, said second segment spaced axially from said first segment, and having a second furnace chamber which is in communication with said first furnace chamber and through which said reagent from said first chamber passes in a longitudinal direction which is parallel to the rotational axis, with said reagent being held in said second furnace chamber in a bed separate from that in said first furnace chamber and electrically isolated therefore; and a first and a second electrode in each said furnace chamber and exposed to said furnace chamber, said electrodes in each furnace chamber being electrically insulated from said furnace shell and being spaced apart so that said reagent in that furnace chamber is heated by direct resistance heating thereof, utilizing the electrodes.

16. A furnace as claimed in claim 15, in which each of the electrodes in each furnace chamber is of annular form and extends circumferentially along an inner surface of the furnace shell while protruding radially inwardly therefrom, with the electrodes in each of the chambers being spaced axially apart.

17. A furnace as claimed in claim 15, wherein the first electrode in each of the chambers extends centrally along the rotational axis, and the second electrodes in each chamber comprise a plurality of electrodes protruding from and extending along an inner surface of the furnace shell in a longitudinal direction which is parallel to the rotational axis, and said plurality of electrodes being spaced circumferentially from one another.

18. A furnace as claimed in claim 15, wherein the electrodes in each of the chambers protrude from and extend along an inner surface of the furnace shell in a longitudinal direction which is parallel to the rotational axis, with the electrodes in each of the chambers being circumferentially spaced from each other.

19. A furnace as claimed in claim 15, wherein the electrodes in each of the chambers are of non-annular form, and protrude from an inner surface of the furnace shell, with the first electrode being spaced in a longitudinal direction which is parallel to the rotational axis, from the second electrode.

20. A furnace as claimed in claim 19, wherein a plurality of the first electrodes, circumferentially aligned and spaced apart circumferentially, and being of the same polarity, as well as a plurality of the second electrodes, circumferentially aligned and spaced apart circumferentially, and being of the same polarity, are provided in each of the chambers with the polarity of the first electrodes being different to that of the second electrodes.

21. A furnace as claimed in claim 15, in which the first and second furnace chambers have the same diameter.

22. A furnace as claimed in claim 21, in which the first and second furnace chambers are of the same length, and in which the first and second electrodes of the first furnace chamber are spaced a different distance apart than the first and second electrodes of the second furnace chamber.

23. A furnace as claimed in claim 15, which includes an annular isolating partition between the first and second furnace chambers for effecting the electrical isolation of the solid reagent in the one chamber from the other chamber.

24. A furnace comprising:

a cylindrical furnace shell located substantially horizontally and rotatable about a rotational axis which thus extends substantially horizontally, the furnace shell providing a first furnace chamber for holding a bed of solid particulate reagent as the furnace shell rotates:

a plurality of non-annular first electrodes protruding from an inner surface of the furnace shell such that they are exposed to the first furnace chamber and are electrically insulated from the furnace shell, the first electrodes being circumferentially aligned and being spaced apart circumferentially, and all being of the stone polarity; and a plurality of non-annular second electrodes protruding from the inner surface of the furnace shell such that they are exposed to the first furnace chamber and are electrically insulated from the furnace shell, the second electrodes also being circumferentially aligned and being spaced apart circumferentially, and all being of the same polarity which is different to the polarity of the first electrodes, with the second electrodes being spaced from the first electrodes in a longitudinal direction which is parallel to the rotational axis and is spaced radially therefrom.

25. The furnace of claim 24 wherein the furnace shell has a first segment and a second segment, said first segment defining said first furnace chamber, said second segment spaced axially from said first segment and defining a second furnace chamber which is in communication with said first furnace chamber such that said reagent from said first furnace chamber can pass in the longitudinal direction to said second furnace chamber, said second furnace chamber is electrically isolated from said first furnace chamber;

a plurality of non-annular third electrodes protruding from the inner surface of the furnace shell such that they are exposed to the second furnace chamber and are electrically insulated from the furnace shell, the third electrodes being circumferentially aligned and being spaced apart circumferentially, and all having the same polarity: and a plurality of non-annular fourth electrodes protruding from the inner surface of the furnace shell such that they are exposed to the second furnace chamber and are electrically insulated from the furnace shell, the fourth electrodes being circumferentially aligned and being spaced apart circumferentially, and all having the same polarity which is different than the polarity of the third electrodes, the fourth electrodes being spaced in the longitudinal direction from the third electrodes.

* * * * *

UNITED STATES PATENT AND TRADEMARK OFFICE

CERTIFICATE OF CORRECTION

| | | |
|---|---|---|
| PATENT NO. | : | 5,579,334 |
| DATED | : | November 26, 1997 |
| INVENTOR(S) | : | Baxter et al. |

It is certified that error appears in the above-identified patent and that said Letters Patent is hereby corrected as shown below:

In claim 2, column 17, line 55, insert "," after "heating".

In claim 15, column 19, line 2, delete "therefore" and insert --therefrom-- therefor.

In claim 24, column 20, line 13, delete "stone" and insert --same-- therefor.

Signed and Sealed this

First Day of April, 1997

*Attest:*

Bruce Lehman

BRUCE LEHMAN

*Attesting Officer*

*Commissioner of Patents and Trademarks*